US008544897B2

(12) United States Patent
Tien

(10) Patent No.: US 8,544,897 B2
(45) Date of Patent: Oct. 1, 2013

(54) STOP DEVICE FOR DOOR LOCK FOR PANIC EXIT DOOR

(75) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 370 days.

(21) Appl. No.: 13/081,554

(22) Filed: Apr. 7, 2011

(65) Prior Publication Data

US 2012/0256428 A1 Oct. 11, 2012

(51) Int. Cl.
*E05B 65/10* (2006.01)
*E05B 65/00* (2006.01)

(52) U.S. Cl.
USPC ..... 292/92; 292/DIG. 65; 292/DIG. 66

(58) Field of Classification Search
USPC ..... 292/92–94, DIG. 65, DIG. 66
See application file for complete search history.

(56) References Cited

U.S. PATENT DOCUMENTS

| | | | | | |
|---|---|---|---|---|---|
| 3,705,739 | A * | 12/1972 | Adler | 292/92 |
| 4,437,693 | A * | 3/1984 | Godec | 292/191 |
| 4,598,939 | A * | 7/1986 | Krupicka et al. | 292/92 |
| 4,709,950 | A * | 12/1987 | Zortman | 292/92 |
| 4,714,285 | A * | 12/1987 | Langham | 292/163 |
| 4,865,367 | A * | 9/1989 | Choi | 292/92 |
| 5,427,420 | A * | 6/1995 | Moore | 292/169 |
| 5,464,259 | A * | 11/1995 | Cohrs et al. | 292/92 |
| 5,588,686 | A * | 12/1996 | Riley et al. | 292/92 |
| 5,690,371 | A * | 11/1997 | Turnbull | 292/163 |
| 5,864,936 | A * | 2/1999 | Riley et al. | 29/434 |
| 6,009,732 | A * | 1/2000 | Haeck et al. | 70/92 |
| 7,488,012 | B2 * | 2/2009 | Eller et al. | 292/164 |
| 7,712,799 | B2 * | 5/2010 | Peng | 292/92 |
| 8,146,961 | B2 * | 4/2012 | Schacht | 292/92 |
| 8,191,939 | B2 * | 6/2012 | Lin | 292/92 |
| 8,267,441 | B2 * | 9/2012 | Lin | 292/92 |
| 2001/0005996 | A1 * | 7/2001 | Haeck et al. | 70/92 |
| 2013/0093195 | A1 * | 4/2013 | Tien | 292/93 |

* cited by examiner

*Primary Examiner* — Carlos Lugo
(74) *Attorney, Agent, or Firm* — Alan Kamrath; Kamrath IP Lawfirm, P.A.

(57) ABSTRACT

A stop device (400) for a door lock includes an anchor (430) pivotable relative to a connecting seat (402). When the anchor (430) is in an alignment position, a through-hole (446) of the anchor (430) is aligned with a positioning groove (420) of the connecting seat (402), and a notch (441) of the anchor (430) is aligned with a slot (414) in the connecting seat (402). When the anchor (430) is in an anchoring position, the through-hole (446) is misaligned from the positioning groove (420), the notch (441) is misaligned from the slot (414), and a stop portion (440) of the anchor (430) is received in and blocks the slot (414). A positioning member (452) is received in the through-hole (446) and the positioning groove (420) to retain the anchor (430) in the alignment position. When the positioning member (452) melts due to heat of a fire, the anchor (430) pivots to the anchoring position under action of gravity, preventing movement of a latch (38) from moving to an unlatching position.

6 Claims, 21 Drawing Sheets

STOP DEVICE FOR DOOR LOCK FOR PANIC EXIT DOOR

BACKGROUND OF THE INVENTION

The present invention relates to a stop device for a door lock and, more particularly, to a stop device for a door lock mounted on a panic exit door to prevent the panic exit door from being opened due to high heat of a fire to prevent the spread of fire and smoke.

A typical lock for a panic exit door generally includes a press bar that can be pressed to retract a latch for unlatching the door in emergency conditions as well as for normal passage. The lock can be locked to prevent unauthorized access and can be unlocked by a key from an outer side of the door. When a fire occurs, the panic exit door should remain in the closed position to avoid the spread of fire and smoke. In an approach, the lock includes a locking member slideable between a first position allowing pressing of the press bar and a second position not allowing pressing of the press bar. However, the locking member can be inadvertently moved to the first position by high-pressure water or steam transformed from the water for extinguishing the fire, resulting in the risk of opening of the panic exit door.

Thus, a need exists for a panic exit door lock that can be reliably maintained in the closed position during a fire.

BRIEF SUMMARY OF THE INVENTION

The present invention solves this need and other problems in the field of panic exit door locks by providing a stop device for a door lock. The door lock includes a bracket adapted to be fixed to a side of a door. A latch is mounted to the bracket and pivotable about a first axis between an extended, latching position and a retracted, unlatching position. A follower includes a first end pivotably connected to the latch, a second end spaced from the first end of the follower along a second axis perpendicular to the first axis, and an extension located intermediate the first and second ends of the follower and extending along a third axis perpendicular to the first and second axes. A linking rod includes first and second ends spaced along the second axis. The first end of the linking rod is pivotably connected to the second end of the follower. The second end of the linking rod is movable in an unlatching direction for moving the latch from the extended, latching position to the retracted, unlatching position and movable in a latching direction opposite to the unlatching direction for moving the latch from the retracted, unlatching position to the extended, latching position. A connecting seat is fixed to the bracket and includes a mounting plate. The mounting plate includes first and second surfaces spaced along the third axis. A first slot extends from the first surface through the second surface. A groove extends from the first surface through the second surface and intersects the first slot. A positioning groove is formed in the first surface of the connecting seat. The extension extends into and is movable along the first slot. An anchor is pivotably mounted to the connecting seat. The anchor includes a pivotal section and an anchoring section spaced from the pivotal section along the second axis. The anchor further includes first and second sides spaced along the third axis. The anchoring section includes a stop portion extending from the second side of the anchor along the third axis. The stop portion further includes inner and outer peripheral faces spaced along the second axis. A first notch extends from the inner peripheral face through the outer peripheral face. A through-hole extends from the first side through the second side of the anchor. The pivotal section of the anchor is pivotably mounted to the connecting seat. The stop portion is received in the groove of the connecting seat. The anchor is pivotable in the groove about the third axis between an alignment position and an anchoring position. When the anchor is in the alignment position, the through-hole of the anchor is aligned with the positioning groove of the connecting seat, and the first notch of the anchor is aligned with the first slot of the connecting seat. When the anchor is in the anchoring position, the through-hole of the anchor is misaligned from the positioning groove of the connecting seat, the first notch of the anchor is misaligned from the first slot of the connecting seat, and the stop portion of the anchor is received in and blocks the first slot. A positioning member is fixed in the through-hole of the anchor. A portion of the positioning member is received in the positioning groove to retain the anchor in the alignment position.

When the positioning member melts due to heat of a fire, the anchor pivots about the third axis from the alignment position to the anchoring position under action of gravity, preventing movement of the follower and preventing the latch from moving from the extended, latching position to the retracted, unlatching position.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
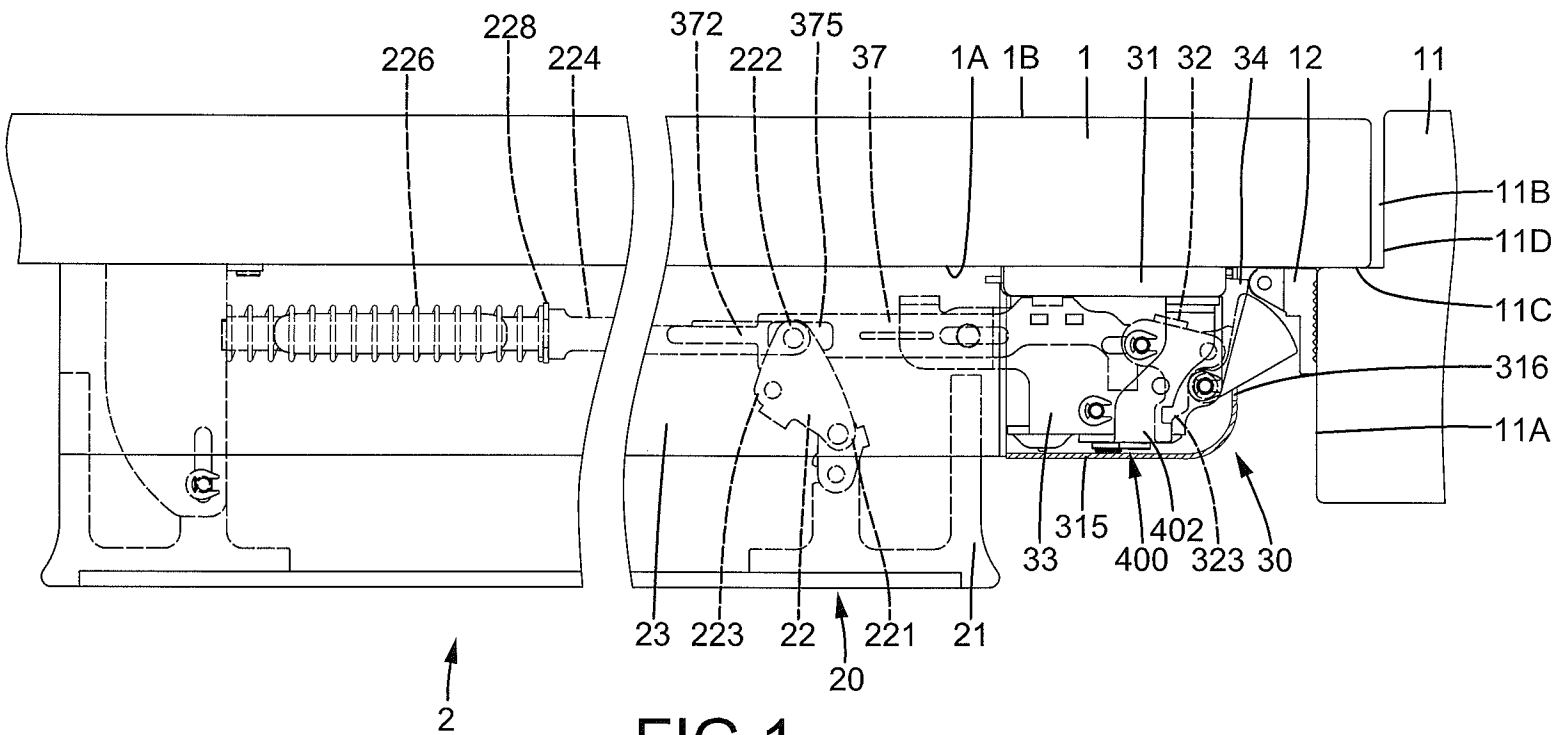
FIG. 1 shows a diagrammatic top view of a door lock with a stop device according to the present invention and a door to which the door lock is mounted, with the door lock in a locked position.
Figure 2:
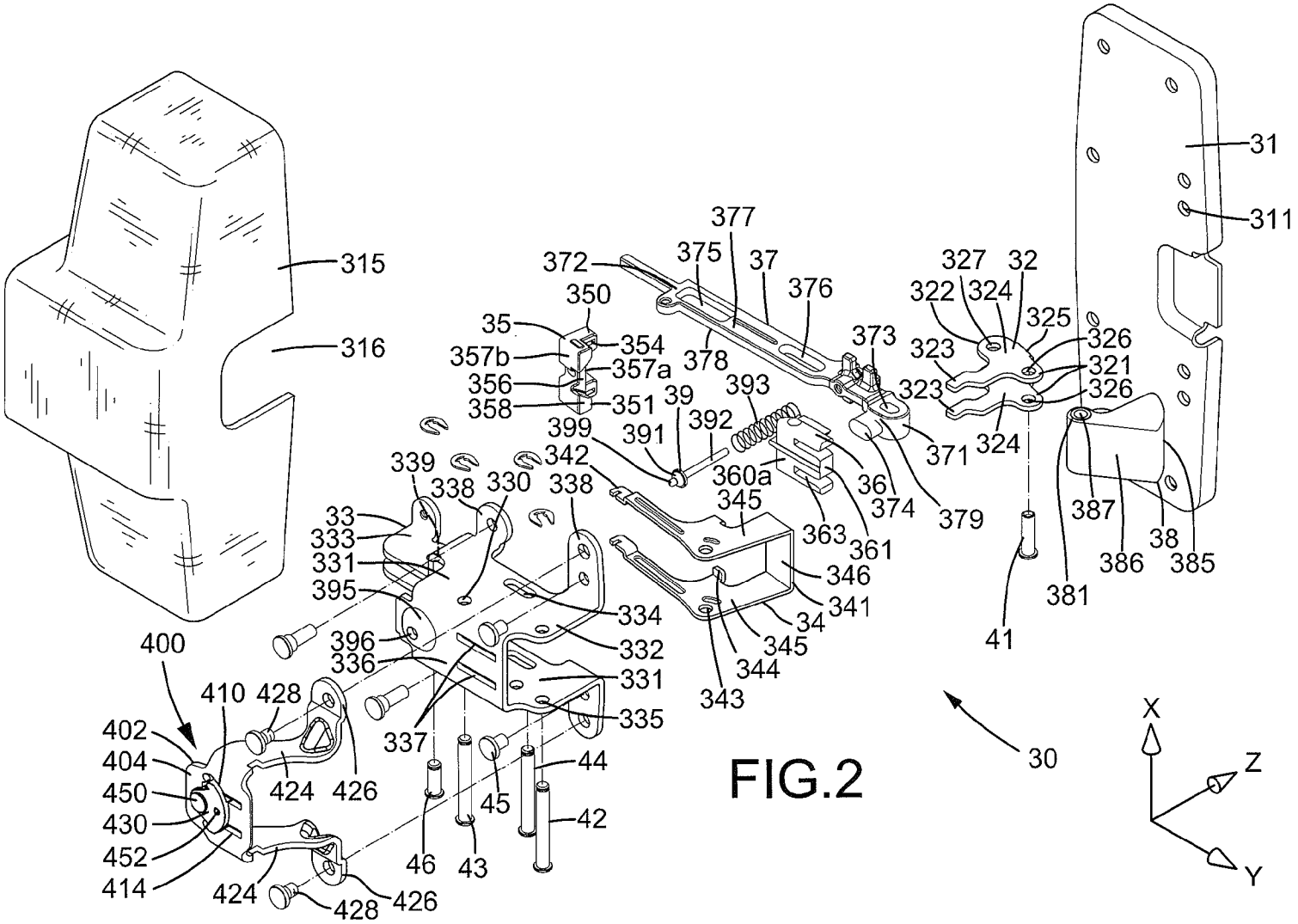
FIG. 2 shows an exploded, perspective view of a latch device and the stop device of the door lock of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "upper", "lower", "front", "rear", "inner", "outer", "end", "portion", "section", "longitudinal", "lateral", "inward", "leftward", "spacing", "length", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A stop device according to the present invention is shown in the drawings and generally designated 400. Stop device 400 is utilized with a door lock 2 mounted to a panic exit door 1 pivotable relative to a door frame 11 having rectangular or inverted U-shaped cross sections. Door frame 11 is fixed to a wall of a passageway and includes an inner face 11A and a stepped portion 11B. Stepped portion 11B includes an abutment face 11C extending perpendicularly from an edge of inner face 11A and a face 11D extending perpendicularly to abutment face 11C and parallel to and spaced from inner face 11A. Door 1 includes first and second sides 1A and 1B. An end of door 1 is pivotably mounted to door frame 11, and door 1 is movable between an open position and a closed position. When door 1 is in the closed position, first side 1A of door 1 abuts abutment face 11C of door frame 11. An end face of the other end of door 1 adjacent to stepped portion 11B is spaced from abutment face 11C. A stop 12 is mounted to inner face 11A of door frame 11.

According to the form shown, door lock 2 includes a latch device 30 having a base 31 fixed to first side 1A of door 1 by fasteners such as screws, bolts, or the like. Base 31 includes a plurality of fixing holes 311. Latch device 30 further includes a bracket 33 having substantially U-shaped cross sections. Bracket 33 includes parallel, spaced first and second sidewalls 331 spaced along a first axis X. Bracket 33 further includes an interconnecting wall 336 interconnected between first and second sidewalls 331 and extending along first axis X. Each of first and second sidewalls 331 has a plurality of engaging portions 338. Fasteners 45 are extended through engaging portions 338 into fixing holes 311 to fix bracket 33 to base 31. Each of first and second sidewalls 331 further includes first and second sections 332 and 333 spaced along a second axis Y perpendicular to first axis X. Aligned pin holes 335 are defined in first sections 332, and aligned holes 339 are defined in second sections 333. First and second sidewalls 331 further include aligned pin holes 330 intermediate holes 339 and pin holes 335. Furthermore, first and second sidewalls 331 include aligned slots 334 intermediate holes 339 and pin holes 335. Interconnecting wall 336 includes two guide slots 337 extending along second axis Y and spaced along first axis X. Interconnecting wall 336 further includes a bulged section 395 spaced from guide slots 337 along second axis Y. Bulged section 395 defines a cavity 397 in an inner face of interconnecting wall 336 and has a hole 396 extending along a third axis perpendicular to first and second axes X and Y.

According to the form shown, latching device 30 further includes a latch 38 having triangular cross sections. Specifically, latch 38 includes a first, inner face 382 having first and second ends, a second, arcuate face 385 having a first end interconnected to the first end of first face 382 and a second end, and a third, outer face 386 having first and second ends interconnected to the second ends of the first and second faces 382 and 385. A pivotal portion 381 is formed at a corner between the second end of first face 382 and the first end of third face 386 and includes a pin hole 387 extending along first axis X. A latch pin 42 is extended through pin holes 335 of bracket 33 and pin hole 387 to pivotably connect latch 38 to bracket 33, allowing latch 38 to pivot between an extended, latching position outside bracket 33 (FIGS. 1, 5, and 10) and a retracted, unlatching position inside bracket 33 (FIGS. 14 and 17) about a pivot axis defined by latch pin 42 and parallel to first axis X. First face 382 includes a coupling block 383 formed thereon and having a pivot hole 384 adjacent pin hole 387. A cover 315 is mounted to base 31 to enclose latch device 30. Cover 315 includes an opening 316 through which latch 38 is movable.

According to the form shown, a linking rod 37 is mounted between and spaced from first and second sidewalls 331 of bracket 33 along first axis X. Linking rod 37 has first and second ends 371 and 372 spaced along second axis Y. Linking rod 37 further includes upper and lower faces 377 and 378 spaced along first axis X. First end 371 of linking rod 37 includes a slot 373 extending along second axis Y and having a front end 373*a* and a rear end 373*b* that is spaced from front end 373*a* along second axis Y and that has a spacing to first end 371 of linking rod 37 larger than front end 337*a*. Slot 373 extends from upper face 377 through lower face 378 of linking rod 37 and is aligned with slots 334 of brackets 33. A limiting pin 44 is slideably extended through slots 334 of bracket 33 and slot 373 of linking rod 37. Linking rod 37 can move idly along second axis Y without actuating limiting pin 44. The idle travel of linking rod 37 is equal to a length of slot 373 along second axis Y. Specifically, when linking rod 37 is between first and second limit positions of its idle travel along second axis Y relative to limiting pin 44, limiting pin 44 received in slot 373 is not moved. However, when movement of linking rod 37 exceeds the first limit position (FIGS. 5 and 10) or the second limit position (FIG. 16), the limiting pin 44 is moved along second axis Y together with linking rod 37. First end 371 of linking rod 37 further includes a lateral face 379 extending between and perpendicular to upper and lower faces 377 and 378 of linking rod 37. A protrusion 374 protrudes from lateral face 379 along third axis Z and between upper and lower faces 377 and 378. Second end 372 of linking rod 37 includes a slot 375. Linking rod 37 further includes a limiting slot 376 between slots 375 and 373 and extending along second axis Y. A pin 46 is extended through holes 339 of bracket 33 and limiting slot 376 to assist in stable movement of linking rod 37 along second axis Y between first and second sidewalls 331 of bracket 33.

Figure 16:
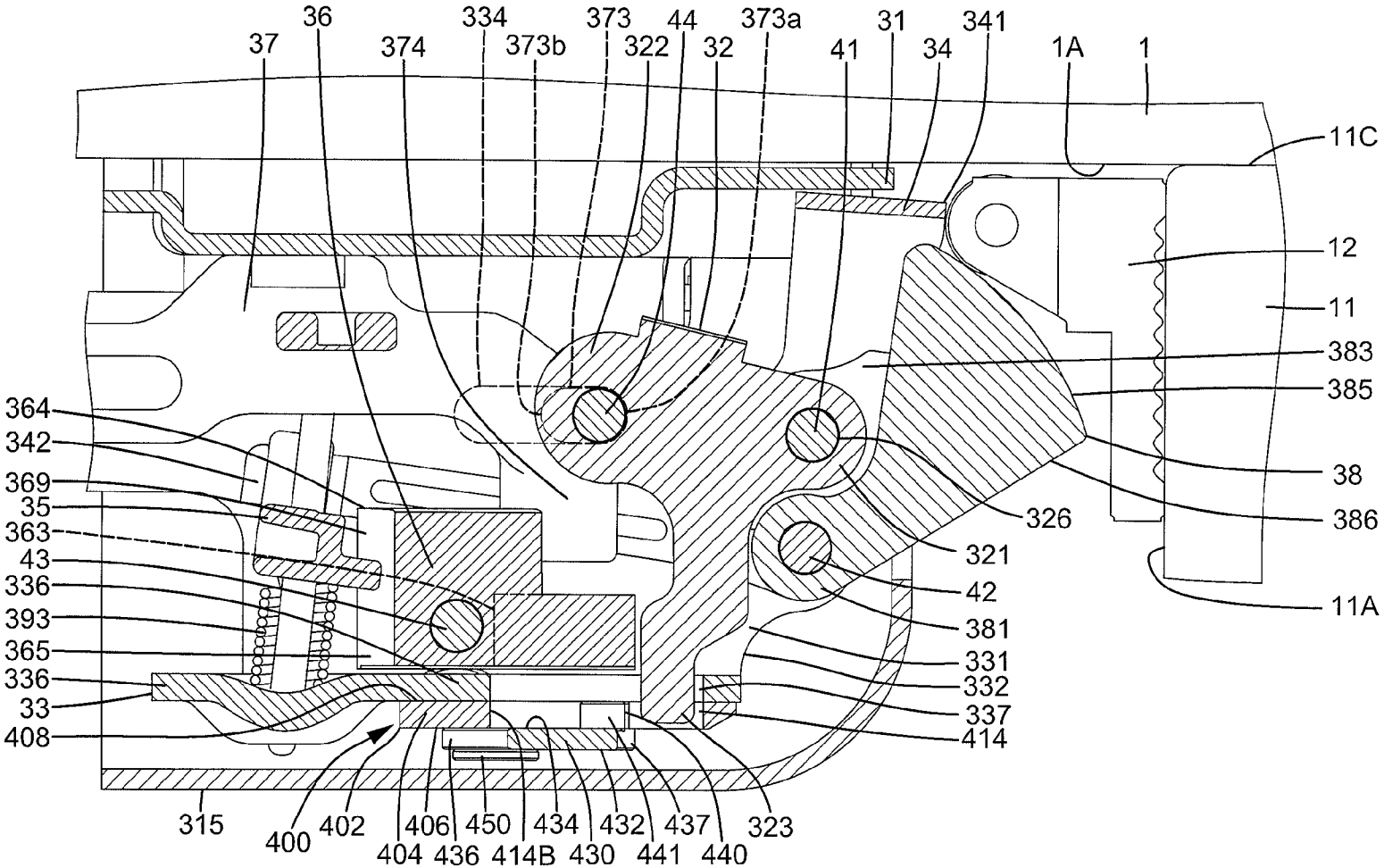
FIG. 16 shows a view similar to FIG. 5, with the linking rod of the panic door lock in a second limit position of the idle travel thereof.

According to the form shown, a follower 32 is pivotably connected to coupling block 383 of latch 38. Follower 32 is substantially U-shaped in cross section and includes parallel first and second side plates 324 spaced along first axis X and an interconnecting plate 325 interconnected between first and second side plates 324. Each of first and second side plates 324 includes first and second ends 321 and 322 and an extension 323 extending from an intermediate portion thereof in a direction away from and perpendicular to interconnecting plate 325. First ends 321 of first and second side plates 324 include aligned pivot holes 326. A pivot 41 extends through pivot hole 384 of coupling block 383 and pivot holes 326 of follower 32, allowing pivotal movement of follower 32 relative to latch 38 about a pivot axis defined by pivot 41 and parallel to and spaced from the pivot axis of latch pin 42. Extensions 323 of follower 32 are slideably extended through guide slots 337 of bracket 33. Second ends 322 of first and second side plates 324 include aligned pin holes 327 through which limiting pin 44 extends. When linking rod 37 is in the first limit position of its idle travel, limiting pin 44 is in rear end 373*b* of slot 373 FIGS. 5 and 10). On the other hand, when linking rod 37 is in the second limit position of its idle travel, limiting pin 44 is in front end 373*a* of slot 373 (FIG. 16). Specifically, limiting pin 44 received in slot 373 is not moved when linking rod 37 is moved from the first limit position to the second limit position in an unlatching direction or moved from the second limit position to the first limit position in a latching direction opposite to the unlatching direction. However, when linking rod 37 in the second limit position (FIG. 16) is further moved leftward (as viewed from FIG. 16) in the unlatching direction away from latch 38 along second axis Y, limiting pin 44 is moved leftward along second axis Y and pivots latch 38 to the retracted, unlatching position.

Figure 14:
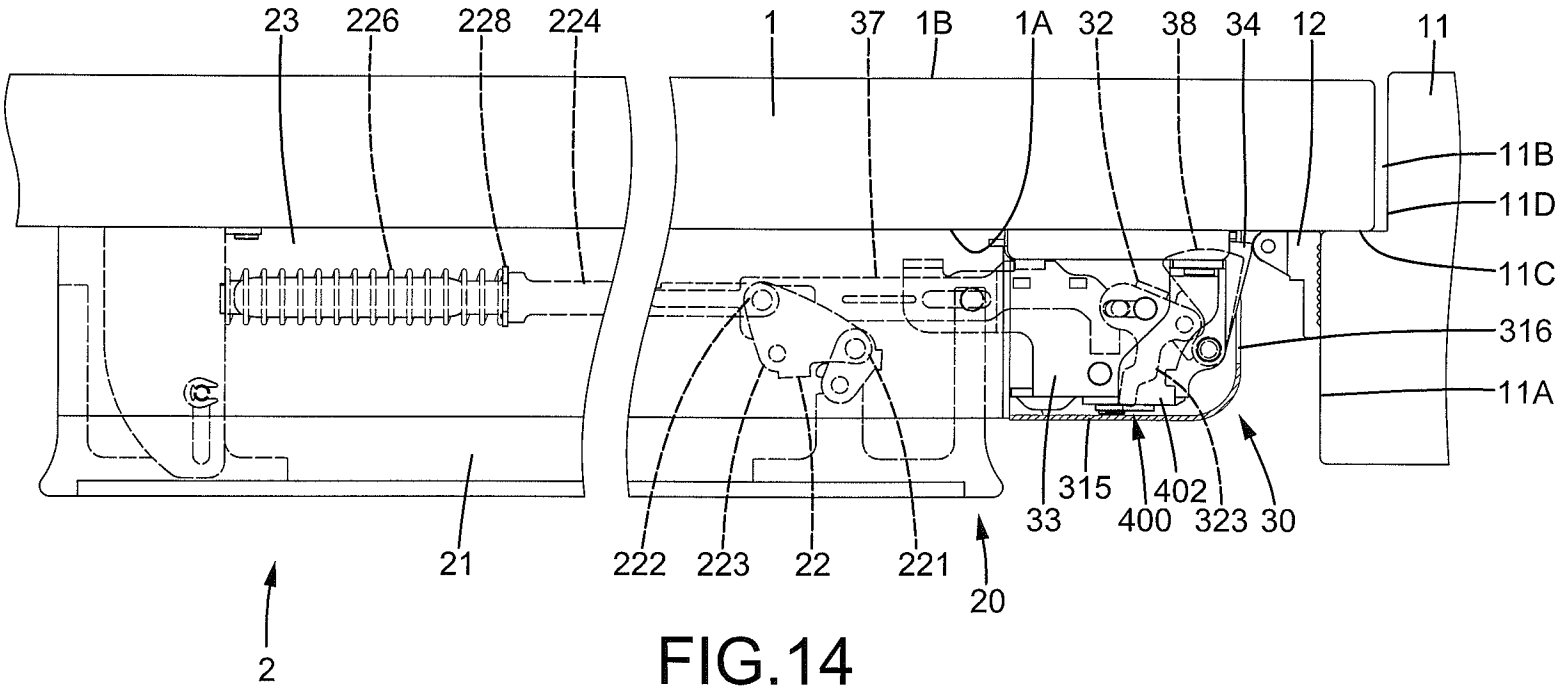
FIG. 14 shows a view similar to FIG. 1, with an operative member pressed to retract a latch.
Figure 17:
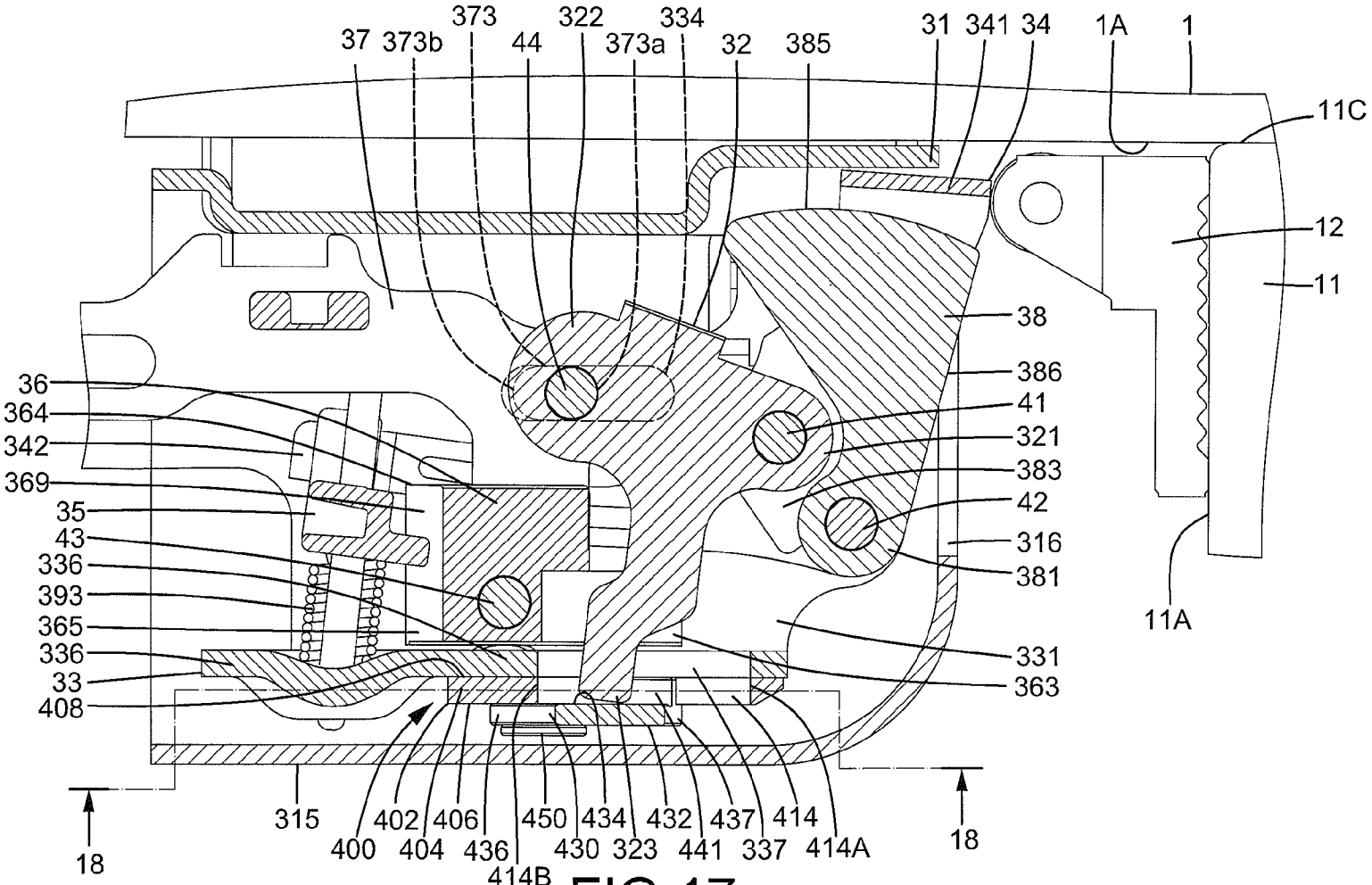
FIG. 17 shows a view similar to FIG. 10, with the operative member pressed to retract the latch.

According to the form shown, lock 2 further includes an operative device 20 coupled with second end 372 of linking rod 37. Operative device 20 includes a housing 23 fixed to the first side 1A of door 1 and an operative member 21 in the form shown as a press bar pivotably coupled to housing 23. A rocker 22 is mounted in housing 23 and includes a first corner 221 pivotably connected to operative member 21, a second corner 222 pivotably coupled with slot 375 of second end 372 of linking rod 37, and a third corner 223 pivotably connected to housing 23. When operative member 21 is operated (e.g., pressed), rocker 22 pivots to move linking rod 37 in the unlatching direction along second axis Y to retract latch 38 to the retracted, unlatching position (FIGS. 14 and 17). A rod 224 has an end coupled to linking rod 37 to move therewith. Specifically, when operative member 21 is operated, rod 224 moves in the unlatching direction away from bracket 33 together with linking rod 37 and compresses a spring 226 mounted between a portion of housing 23 and a plate 228 fixed to rod 224. When operative member 21 is released, linking rod 37 and rod 224 move in the latching direction and return to positions shown in FIG. 1 under the action of spring 226, and latch 38 moves to the extended, latching position outside bracket 33. Other arrangements for returning linking rod 37 and latch 38 would be within the skill of the art. Furthermore, operative device 20 for actuating linking rod 37 can be of any desired form as conventional including but not limited to of a commercially available type.

Figure 3:
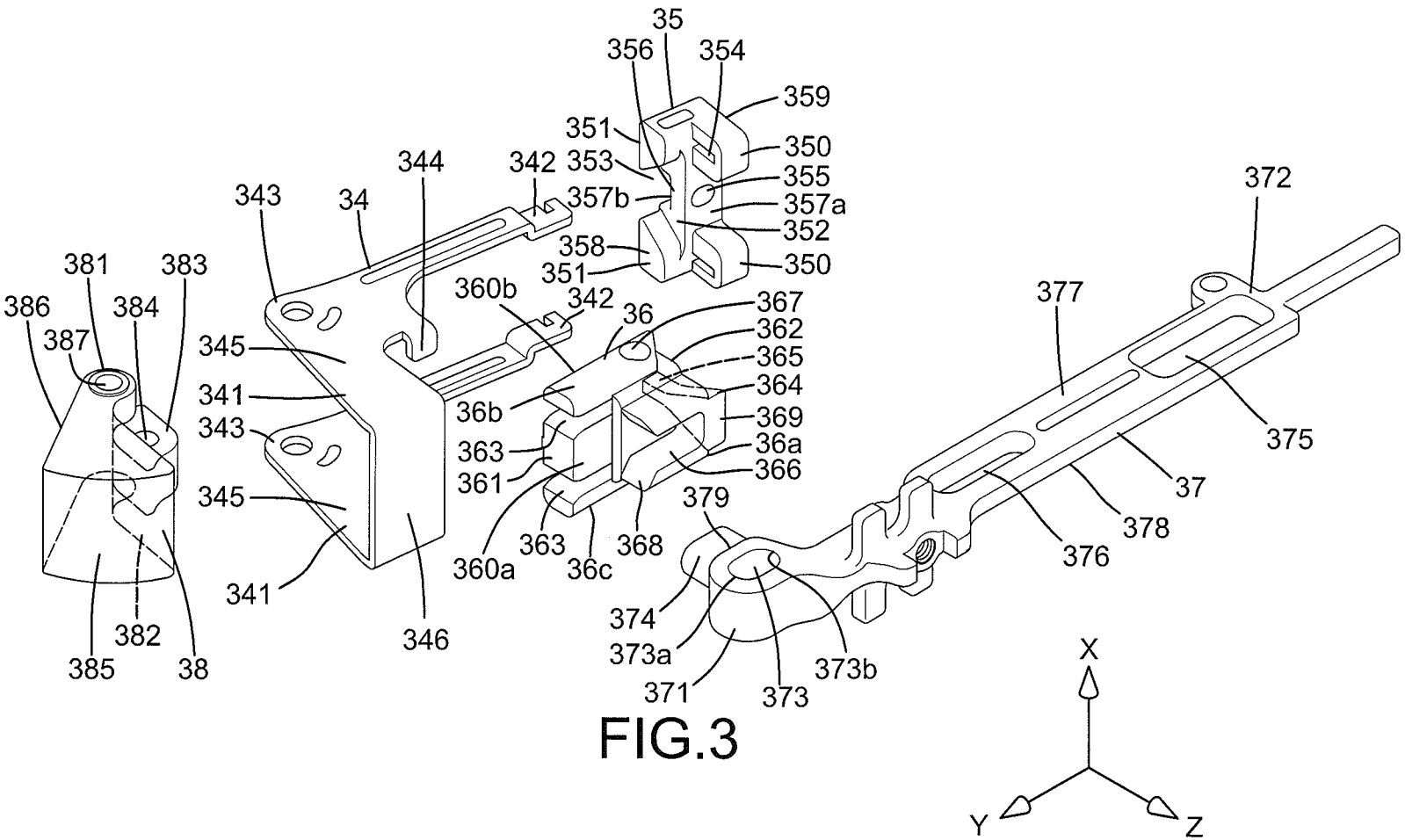
FIG. 3 shows an enlarged, exploded, perspective view of some components of the latch device of FIG. 2.

According to the form shown, a locking member 36 is mounted between first and second sidewalls 331 of bracket 33 and spaced from first end 371 of linking rod 37. Locking member 36 is substantially E-shaped in cross section. Specifically, locking member 36 includes front and rear faces 361 and 362 spaced along second axis Y. Locking member 36 further includes first and second lateral faces 360*a* and 360*b* extending perpendicularly to and between front and rear faces 361 and 362. First lateral face 360*a* faces linking rod 37 and includes a lump 36*a* formed on a rear portion thereof distant to front face 361. Lump 36*a* includes a groove 366 facing protrusion 374 of linking rod 37 and having an end opening 368. End opening 368 has a spacing to front face 361 along second axis Y smaller than groove 366. Furthermore, end opening 368 has increasing widths along first axis X away from rear face 362 of locking member 36 (FIG. 3). Locking member 36 further includes top and bottom faces 36*b* and 36*c* spaced along first axis X and extending perpendicularly to and between front and rear faces 361 and 362 and extending perpendicularly to and between first and second lateral faces 360*a* and 360*b*. A vertical hole 367 extends from top face 36*b* through bottom face 36*c* of locking member 36. A guide pin 43 is extended through pin holes 330 of bracket 33 and vertical hole 367 of locking member 36, allowing movement of locking member 36 between an upper, unlocking position and a lower, locking position spaced from the upper, unlocking position along first axis X. Two guide grooves 363 extend from front face 361 towards but spaced from rear face 362 along second axis Y. Guide grooves 363 are spaced along first axis X and spaced from top and bottom faces 36*b* and 36*c* of locking member 36. Furthermore, guide grooves 363 are spaced from groove 366 along third axis Z. A guide piece 364 in the form shown as a lug is formed on rear face 362 of locking member 36 and integrally formed with lump 36*a* as a single continuous monolithic member. Guide piece 364 includes a narrower section 365 and a wider section 369. Wider section 369 has a spacing to second lateral face 360*b* along third axis Z larger than narrower section 365 and has a width along first axis X larger than that of narrower section 365. Wider section 369 includes triangular cross sections (when viewing rear face 362 along second axis Y) and has decreasing widths toward narrower section 365 along third axis Z.

According to the form shown, a substantially U-shaped swaying plate 34 is pivotably mounted in bracket 33. Swaying plate 34 includes parallel first and second side boards 345 spaced along first axis X and received between sidewalls 331 of bracket 33. Swaying plate 34 further includes an interconnecting board 346 interconnected between first and second side boards 345. Each of first and second side boards 345 is substantially L-shaped and includes a first end 341 interconnected to interconnecting board 346, a second end 342, and a pivotal portion 343 on an intermediate portion intermediate the first and second ends 341 and 342. Second ends 342 of first and second side boards 345 are received between first and second sidewalls 331 of bracket 33. First ends 341 of first and second side boards 345 of swaying plate 34 are movable through opening 316 between a first, outer position outside of cover 315 and a second, inner position partially received in cover 315. Latch pin 42 is extended through aligned pin holes in pivotal portions 343 of swaying plate 34 to allow pivotal movement of swaying plate 34 about the pivot axis defined by latch pin 42. Each of first and second side boards 345 includes a drive piece 344 formed on the intermediate portion thereof and adjacent to first end 341 thereof. Drive pieces 344 extend toward each other along first axis X.

According to the form shown, a limiting block 35 is mounted to swaying plate 34 to move therewith. Limiting block 35 is movable between a holding position corresponding to the first, outer position of first ends 341 of first and second side boards 345 of swaying plate 34 and a releasing position corresponding to the second, inner position of first ends 341 of first and second side boards 345 of swaying plate 34. Limiting block 35 includes first and second lateral faces 357*a* and 357*b* spaced along third axis Z. Limiting block 35 further includes front and rear faces 358 and 359 spaced along second axis Y and extending perpendicularly to and between first and second lateral faces 357*a* and 357*b*. Upper and lower ears 350 are formed on upper and lower ends of first lateral face 357*a* and spaced along first axis X. Each of upper and lower ears 350 has an engaging groove 354 formed in a front face thereof. Second ends 342 of first and second side boards 345 of swaying plate 34 are coupled with engaging grooves 354 to allow joint pivotal movement of swaying plate 34 and limiting block 35. A through-hole 355 extends from first lateral face 357*a* through second lateral face 357*b* along third axis Z and is intermediate upper and lower ears 350. A guide groove 356 is formed in an intermediate portion of front face 358 of limiting block 35 and extends from first lateral face 357*a* through second lateral face 357*b* along third axis Z, leaving upper and lower protrusions 351 on upper and lower ends of front face 358. Guide groove 356 is substantially trapezoidal in cross section and includes a first, larger end 352 in first lateral face 357*a* and a second, smaller end 353 in second lateral face 357*b*. Second, smaller end 353 is spaced from first, larger end 352 along third axis Z. Second, smaller end 353 has a width along first axis X smaller than a width of the first, larger end 352 along first axis X. Specifically, guide groove 356 has decreasing widths from first, larger end 352 toward second, smaller end 353. Second, smaller end 353 of guide groove 356 has a minimum width along first axis X smaller than a maximum width of wider section 369 of guide piece 364 of locking member 36 along first axis X.

According to the form shown, a guide rod 39 is mounted between limiting block 35 and interconnecting wall 336 of bracket 33. Specifically, guide rod 39 includes a head 391 and a shank 392 extending from a side of head 391 and having an end slideably received in through-hole 355 of limiting block 35. The other side of head 391 is domed and includes a tip 399 extending through hole 396 of bulged section 395 to prevent head 391 from disengaging from interconnecting wall 336. An outer periphery of the domed side of the head 391 slideably abuts an inner periphery of hole 396 of bulged section 395 so that head 391 can swivel against the inner periphery of hole 396 when shank 392 moves together with limiting block 35. A spring 393 is mounted around shank 392 between the side of head 391 and second lateral face 357*b* of limiting block 35. Note that a portion of head 391 outside of hole 396 is received in cavity 397 to avoid interference in operation of guide rod 39 and other components.

According to the form shown, latch device 30 includes stop device 400 having a connecting seat 402 mounted to bracket 33. Connecting seat 402 includes a mounting plate 404 having first and second surfaces 406 and 408 spaced along third axis Z. Mounting plate 404 further includes first and second slots 414 extending from first surface 406 through second surface 408. First slot 414 is spaced from and located above second slot 414 along first axis X. Each of first and second slots 414 includes front and rear ends 414A and 414B spaced along second axis Y and has a length along second axis Y approximately the same as the length of each guide slot 337 along second axis Y. Mounting plate 404 further includes a substantially C-shaped groove 410 extending from first surface 406 through second surface 408 and intersecting first and second slots 414. Groove 410 includes first and second ends 412 spaced in a circumferential direction about third axis Z. First end 412 of groove 410 is adjacent to rear end 414B of first slot 414. Second end 412 of groove 410 is adjacent to rear end 414B of second slot 414. Furthermore, rear ends 414B of first and second slots 414 are located between first and second ends 412 of groove 410 along first axis X. Groove 410 and first and second slots 414 together define a tongue 416 on mounting plate 404. Tongue 416 includes an end face 418 facing front ends 414A of first and second slots 414. End face 418 includes a positioning groove 420. Tongue 416 further includes an axle hole 422 extending from first surface 406 through second surface 408 of mounting plate 404. Axle hole 422 is located intermediate rear ends 414B of first and second slots 414 and spaced from positioning groove 420 along second axis Y.

According to the form shown, connecting seat 402 further includes two legs 424 extending from two lateral edges of mounting plate 404 along third axis Z. Each leg 424 includes a distal end having a connecting portion 426 extending along first axis X. Mounting plate 404 is mounted to bracket 33 by extending fasteners 428, such as screws, through connecting portions 426 of connecting seat 402 and engaging portions 338 of bracket 33 into fixing holes 311 of base 31. Second surface 408 of mounting plate 404 faces interconnecting wall 336 of bracket 33. First and second sidewalls 331 of bracket 33 are located intermediate legs 424. First and second slots 414 of connecting seat 402 are aligned with guide slots 337 of bracket 33. Extensions 323 of first and second side plates 324 of follower 32 extend into first and second slots 414 of connecting seat 402. When latch 38 is in the latching position, extensions 323 of follower 32 are located adjacent to front ends 414A of first and second slots 414 of connecting seat 402. When latch 38 is in the unlatching position, extensions 323 of follower 32 are located adjacent to rear ends 414B of first and second slots 414 of connecting seat 402.

Figure 4:
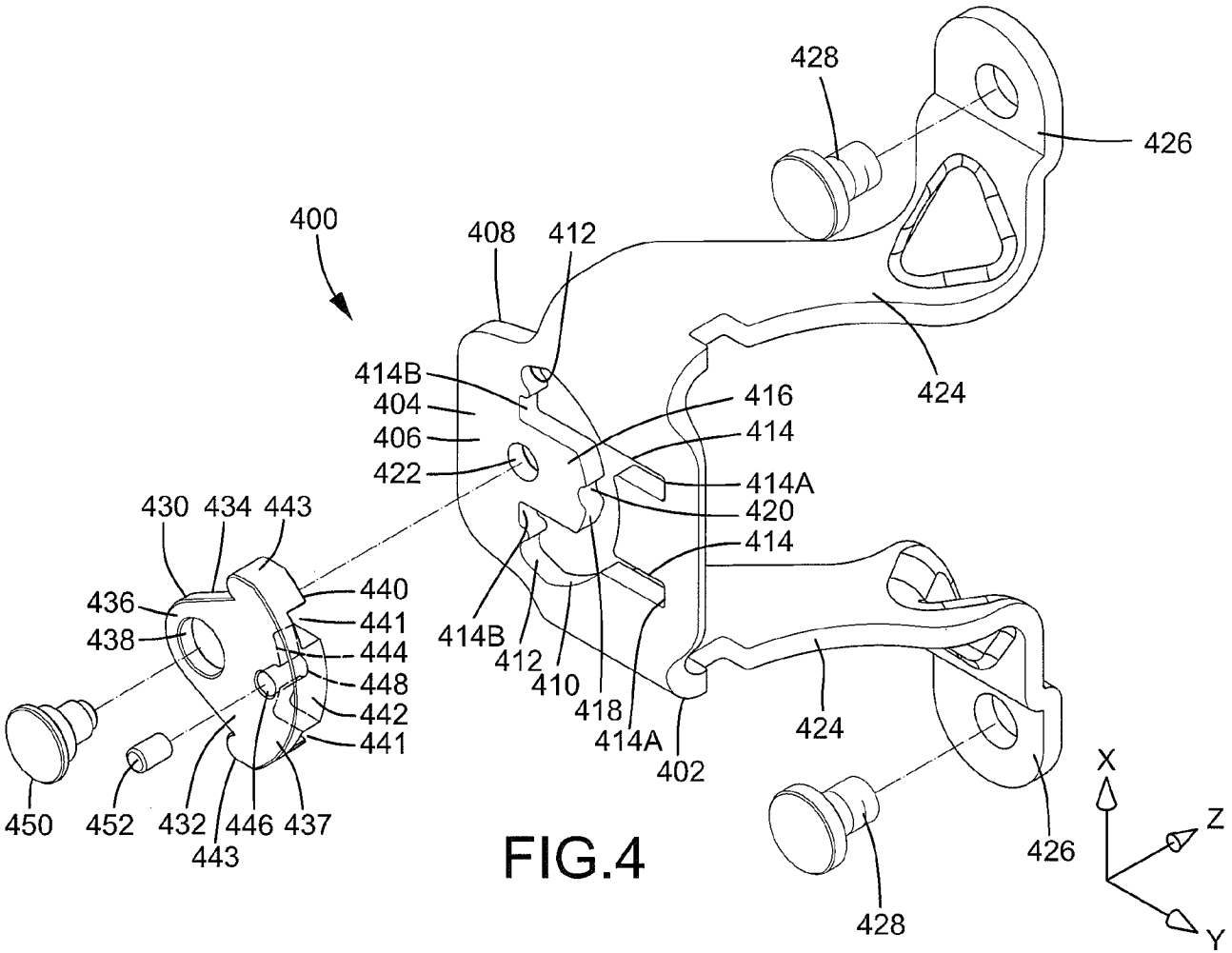
FIG. 4 shows an exploded, perspective view of the stop device of FIG. 1.
Figure 4A:
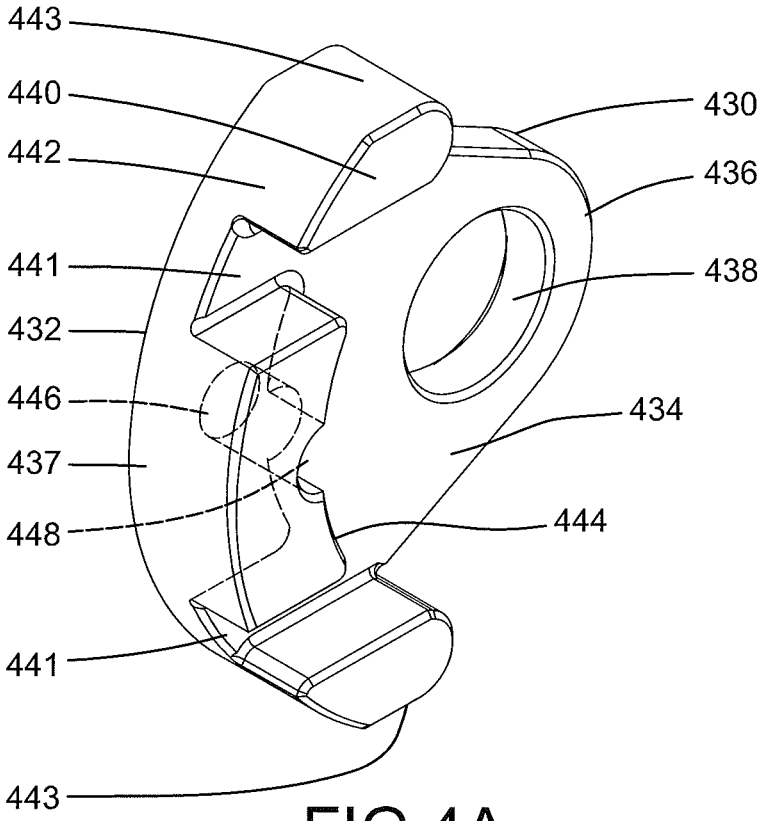
FIG. 4A shows another exploded, perspective view of an anchor of the stop device of FIG. 4.
Figure 10:
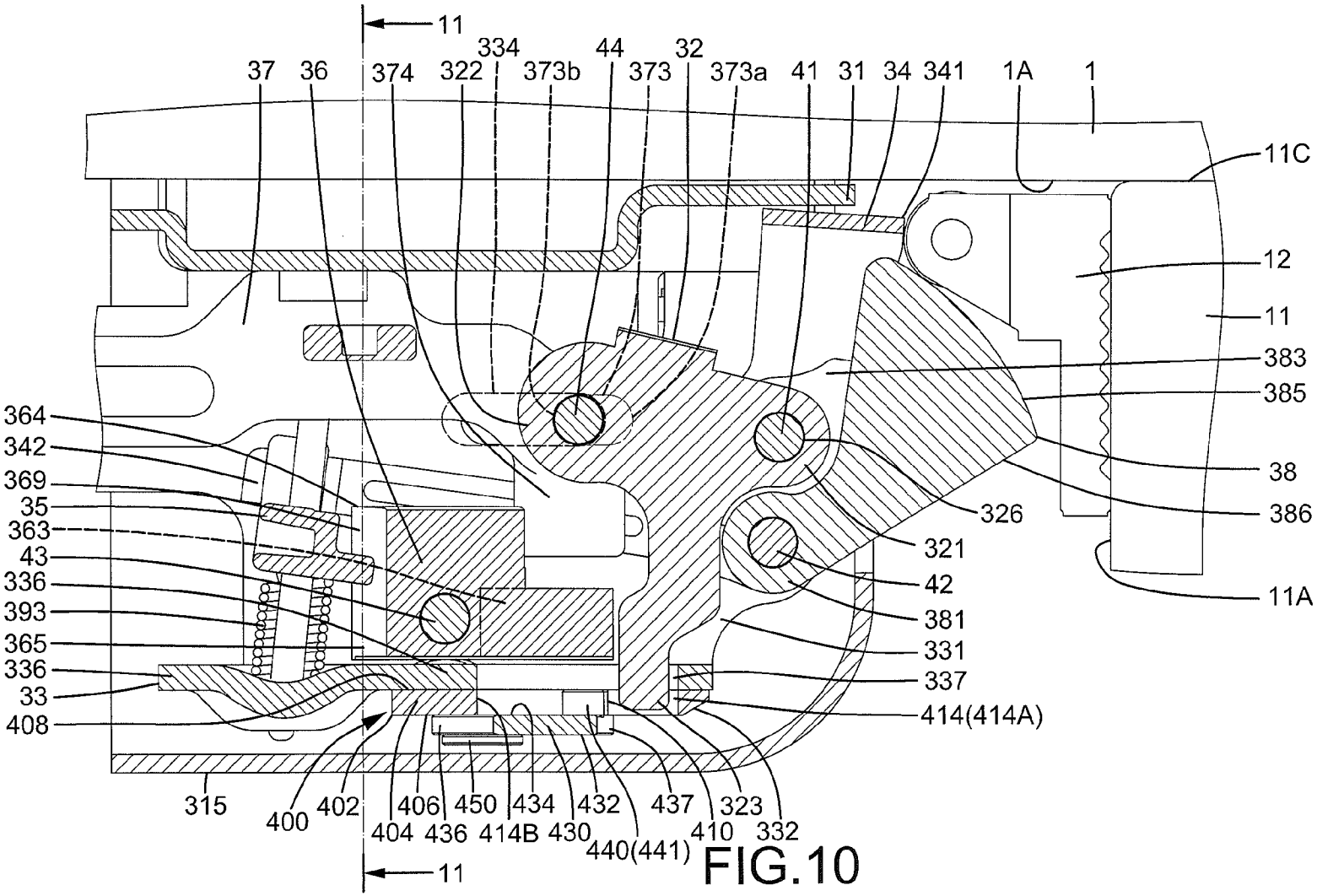
FIG. 10 shows a partial, cross sectional view of the door and the door lock of FIG. 1, with the door in a closed position.
Figure 19:
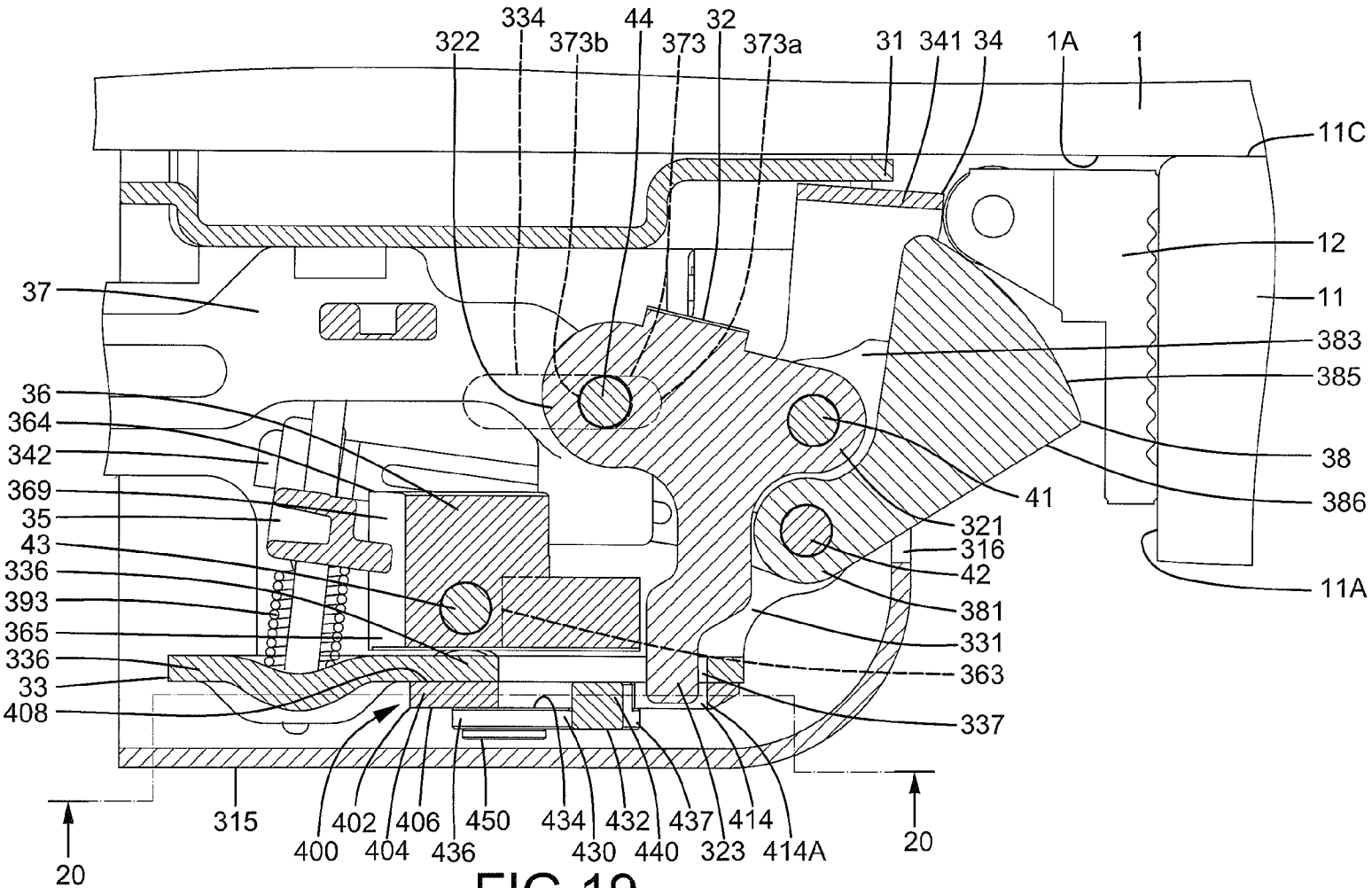
FIG. 19 shows a cross-sectional view similar to FIG. 17, with a positioning member melted due to fire and with the anchor pivoted to an anchoring position.
Figure 20:
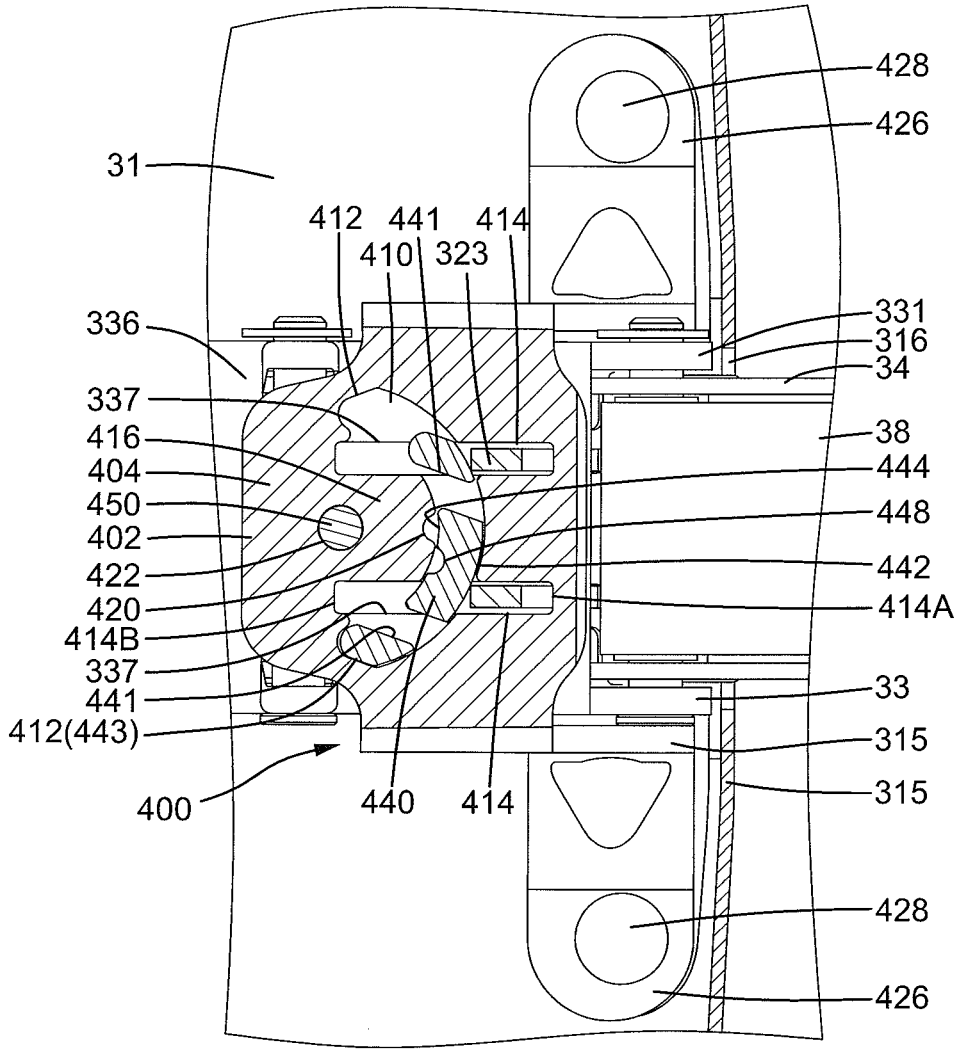
FIG. 20 shows a cross-sectional view taken along section line 20-20 of FIG. 19.

According to the form shown, stop device 400 further includes an anchor 430 pivotably mounted to connecting seat 402. Anchor 430 includes substantially sector-shaped cross sections. Anchor 430 includes first and second sides 432 and 434 spaced along third axis Z. Anchor 430 further includes a pivotal section 436 and an arcuate anchoring section 437 spaced from pivotal section 436 along second axis Y. A pivot hole 438 extends from first side 432 through second side 434 and is located in pivotal section 436. A through-hole 446 extends from first side 432 through second side 434 and is spaced from pivot hole 438 along second axis Y. A stop portion 440 extends from second side 434 of anchor 430 along third axis Z. Stop portion 440 includes inner and outer peripheral faces 444 and 442 spaced along second axis Y. Stop portion 440 further includes two distal ends 443 spaced in a circumferential direction about third axis Z. First and second notches 441 (FIG. 4A) extend from outer peripheral face 442 through inner peripheral face 444 along second axis Y and are spaced from each other along first axis X. Each of first and second notches 441 extends to second side 434 along third axis 1 Stop portion 440 further includes an engagement groove 448 in a center of inner peripheral face 444 in aligned and in communication with through-hole 446. Pivot hole 438 of anchor 430 is aligned with axle hole 422. Second side 434 of anchor 430 abuts first surface 406 of connecting seat 402. Stop portion 440 of anchor 430 is received in groove 410 of connecting seat 402 (FIG. 10). An axle 450 is extended through pivot hole 438 of anchor 430 into axle hole 422 of connecting seat 402, allowing anchor 430 to pivot about third axis Z between an alignment position (FIGS. 5, 6, and 10) and an anchoring position (FIGS. 19 and 20). When anchor 430 is in the alignment position, through-hole 446 and engagement groove 448 of anchor 430 are aligned with positioning groove 420 of connecting seat 402. First and second notches 441 of anchor 430 are aligned with first and second slots 414 of connecting seat 402. On the other hand, when anchor 430 is in the anchoring position, the lower distal end 443 of stop portion 440 of anchor 430 abuts second end 412 of groove 410, such that through-hole 446 and engagement groove 448 of anchor 430 are misaligned from positioning groove 420 of connecting seat 402 and such that first and second notches 441 of anchor 430 are misaligned from first and second slots 414 of connecting seat 402 (FIG. 20). Thus, stop portion 440 of anchor 430 is received in and blocks first and second slots 414. In this case, movement of latch 38 from the latching position to the unlatching position is avoided, because extensions 323 of follower 32 abut and are stopped by outer peripheral face 442 of stop portion 440 of anchor 430. Additionally, when anchor 430 is in the alignment position, a positioning member 452 made of plastic material is extended through through-hole 446 of anchor 430 and engaged in engagement groove 448 of anchor 430 and positioning groove 420 of tongue 416 of connecting seat 402. Thus, anchor 430 is retained in the alignment position by positioning member 452, allowing movement of latch 38 through operation.

Figure 5:
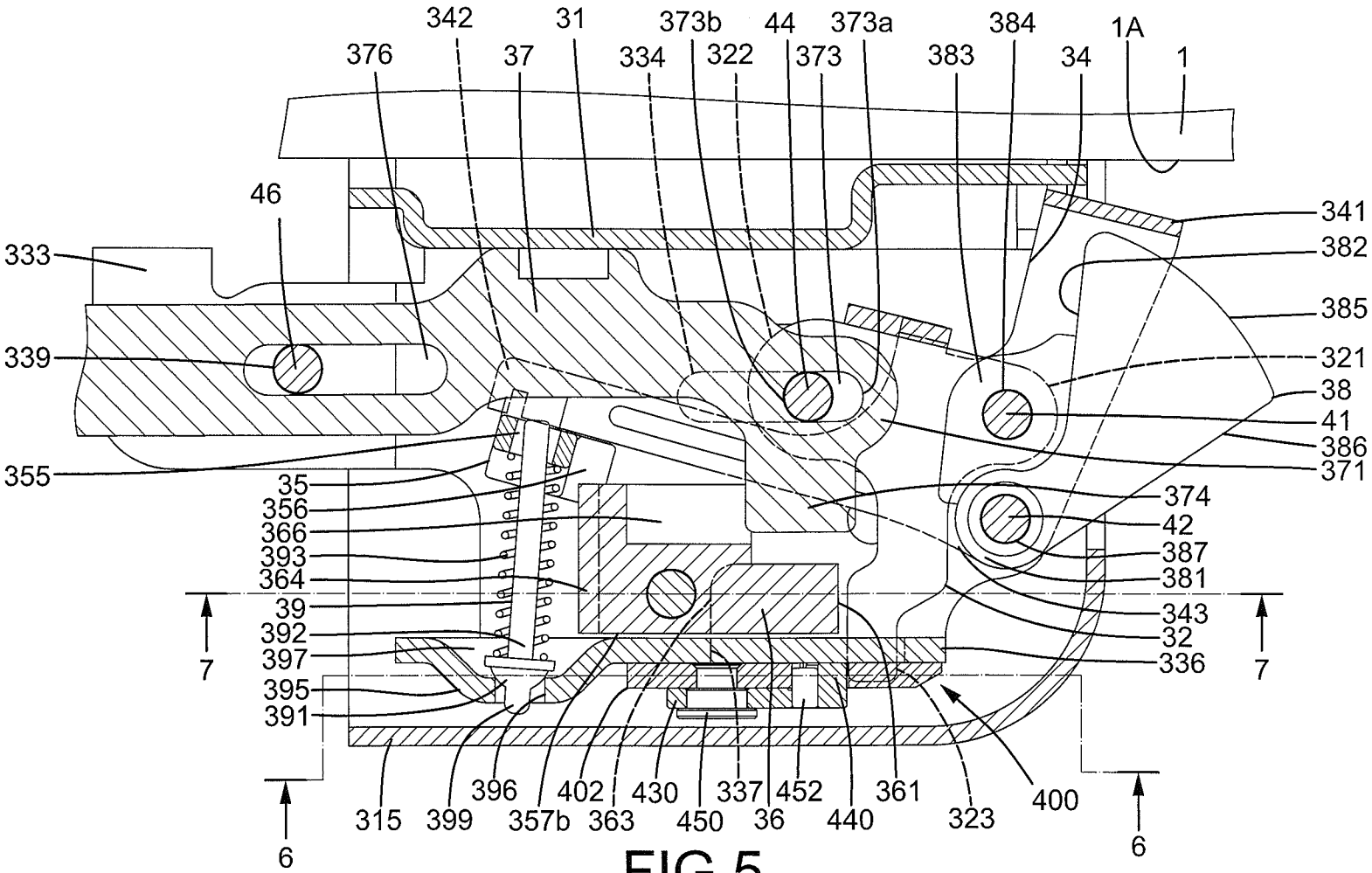
FIG. 5 shows a partial, enlarged, cross-sectional view of the door and the door lock of FIG. 1, with the door in an open position and with a linking rod of the door lock in a first limit position of an idle travel thereof.
Figure 6:
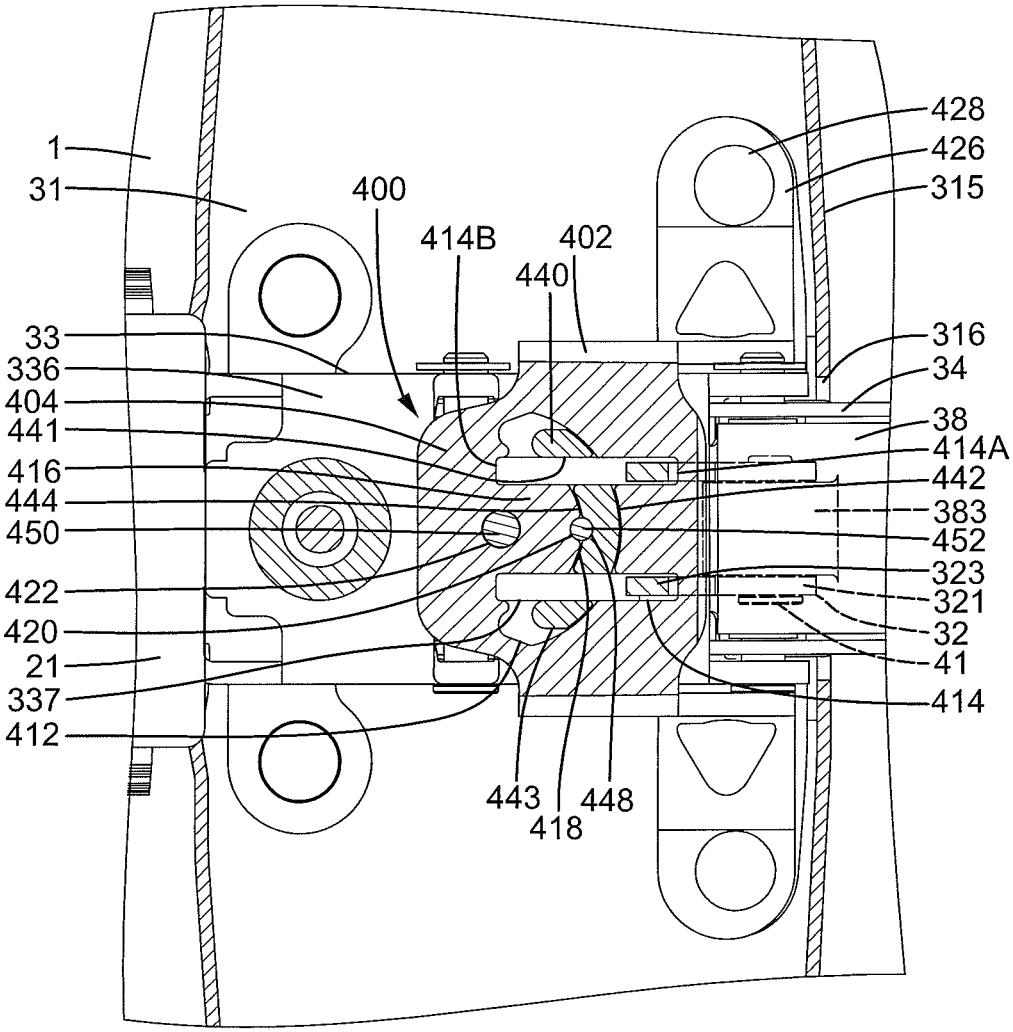
FIG. 6 shows a cross-sectional view taken along section line 6-6 of FIG. 5.
Figure 7:
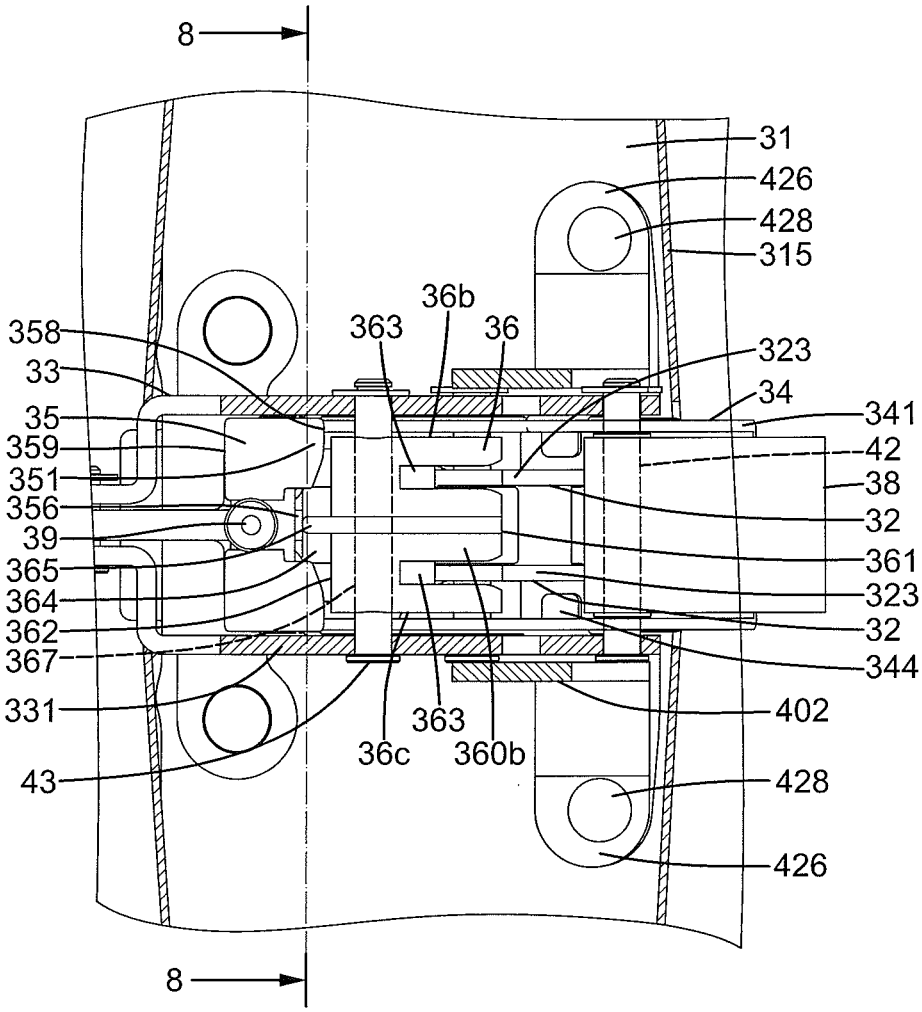
FIG. 7 shows a cross-sectional view taken along section line 7-7 of FIG. 5.
Figure 8:
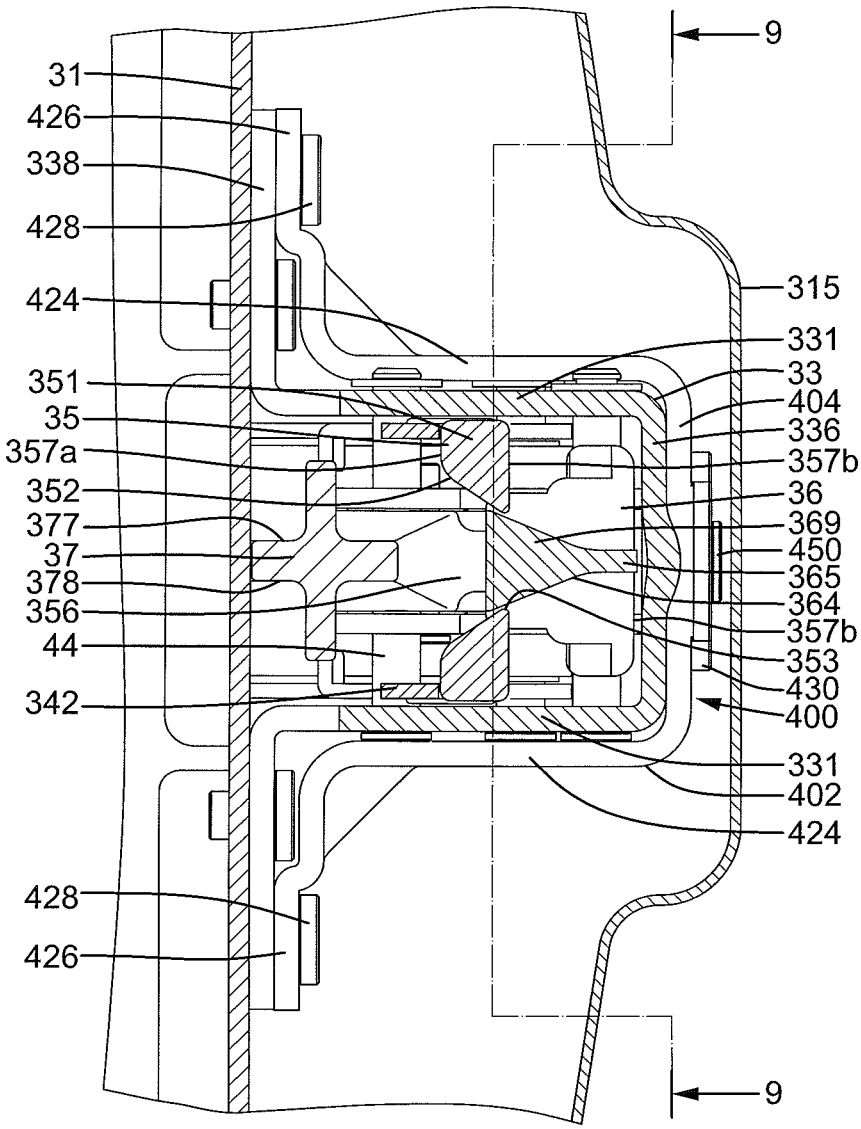
FIG. 8 shows a cross-sectional view taken along section line 8-8 of FIG. 7.
Figure 9:
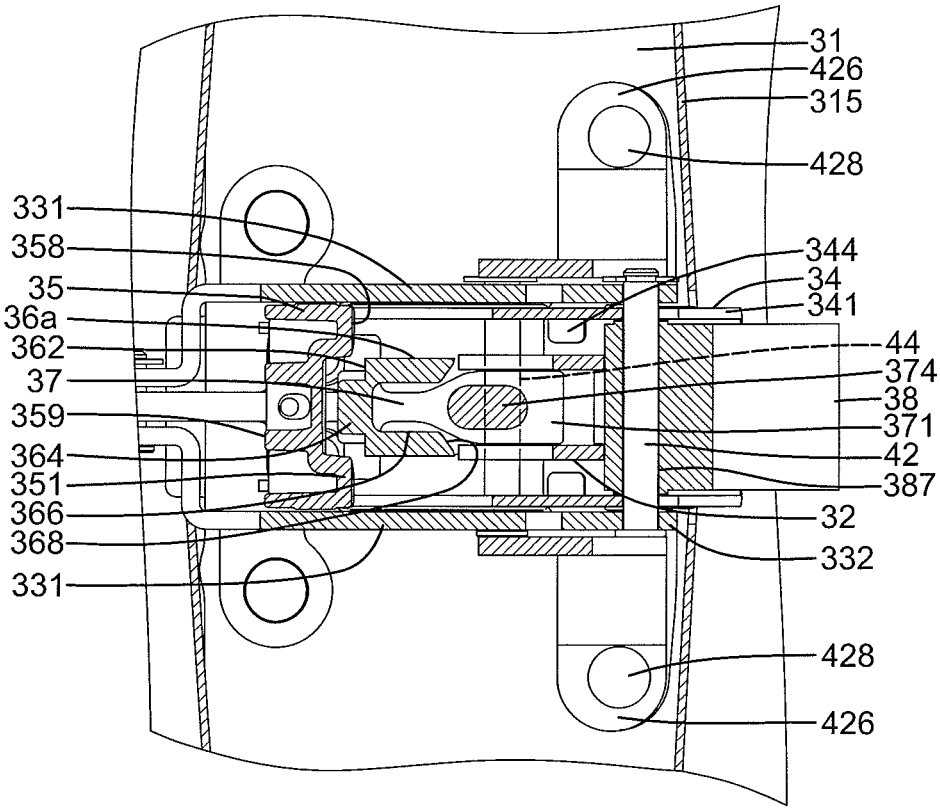
FIG. 9 shows a cross-sectional view taken along section line 9-9 of FIG. 8.

Now that the basic construction of door lock 2 of the present invention has been explained, the operation and some of the advantages of door lock 2 can be set forth and appreciated. In particular, for the sake of explanation, it will be assumed that door 1 is not closed (FIG. 5) and latch 38 is in its extended, latching position. First ends 341 of first and second side boards 345 of swaying plate 34 are in the first, outer position outside of cover 315 under the action of spring 393 that presses against limiting block 35 fixed to swaying plate 34. In this case, limiting block 35 is in the holding position holding locking member 36 in its upper, unlocking position (FIG. 7), and wider section 369 of guide piece 364 of locking member 36 is received in second, smaller end 353 of guide groove 356 of limiting block 35. Furthermore, guide grooves 363 of locking member 36 are aligned with extensions 323 of follower 32. Further, linking rod 37 is in its first limit position. Specifically, protrusion 374 of linking rod 37 is aligned with but outside of groove 366 (FIG. 9), and limiting pin 44 is in rear end 373*b* of slot 373 (FIG. 5). First and second notches 441 of anchor 430 are aligned with guide slots 337 of bracket 33 (FIG. 6). In this state, latch 38 can be pivoted from the latching position to the unlatching position.

Figure 18:
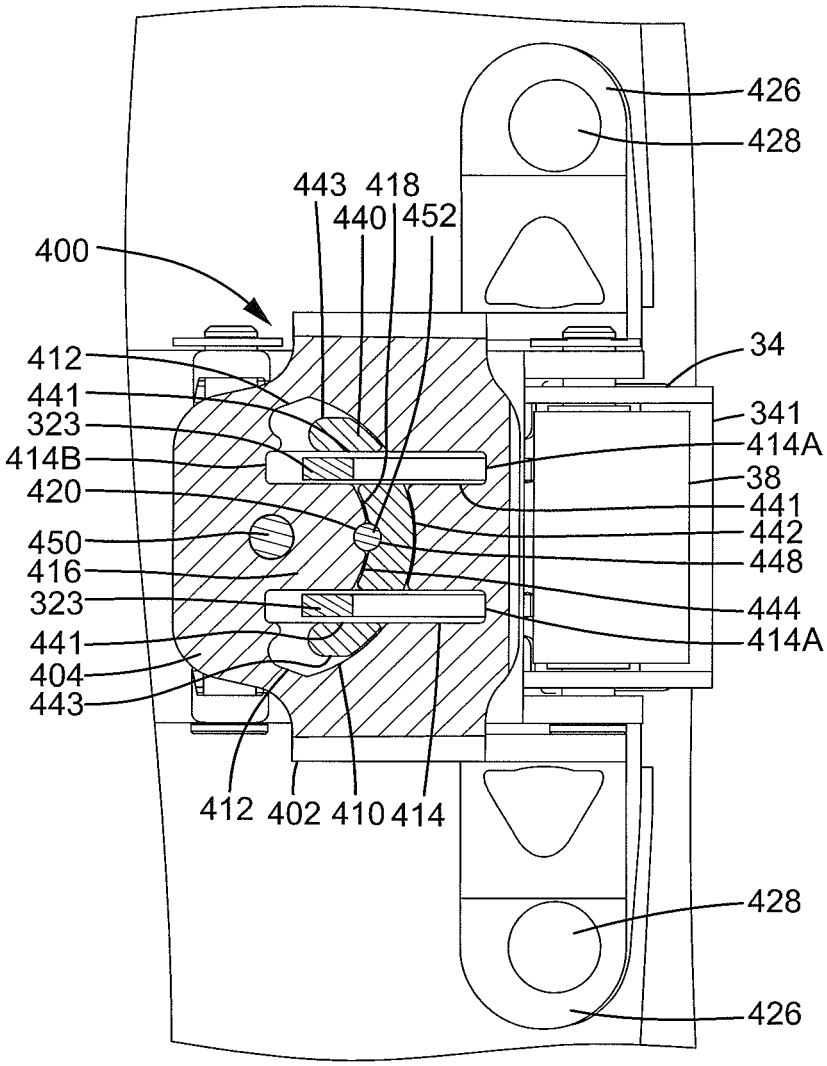
FIG. 18 shows a cross-sectional view taken along section line 18-18 of FIG. 17.

When closing door 1, third face 386 of latch 38 is pressed against by stop 12 and, thus, pivots inward (FIG. 10). Follower 32 pivots inward together with latch 38 so that extensions 323 of follower 32 are extended through and are engaged with guide grooves 363 of locking member 36. Furthermore, extensions 323 of follower 32 move from a location adjacent front ends 414A of first and second slots 414 of connecting seat 402 (FIGS. 6 and 10) along second axis Y to a location adjacent rear ends 414B of first and second slots 414 of connecting seat 402 (FIGS. 17 and 18). Pivotal movement of follower 32 also causes movement of limiting pin 44 in the unlatching direction away from latch 38, which, in turn, moves linking rod 37 in the unlatching direction away from latch 38 so that protrusion 374 of linking rod 37 is moved into and engaged with groove 366 of locking member 36. Furthermore, first face 382 of latch 38 presses against drive pieces 344 of swaying plate 34 to make first ends 341 of first and second side boards 345 of swaying plate 34 pivot inward to the inner, second position, and limiting block 35 is moved to the releasing position. Specifically, guide groove 356 of limiting block 35 is moved to a position where second, smaller end 353 is aligned with and receives narrower section 365 of guide piece 364 of locking member 36. Namely, locking member 36 is no longer restrained by limiting block 35 but is still held in the upper, unlocking position by protrusion 374. Note that first, larger end 352 of guide groove 356 provides a space allowing passage of wider section 369 of guide piece 364 of locking member 36.

Figure 11:
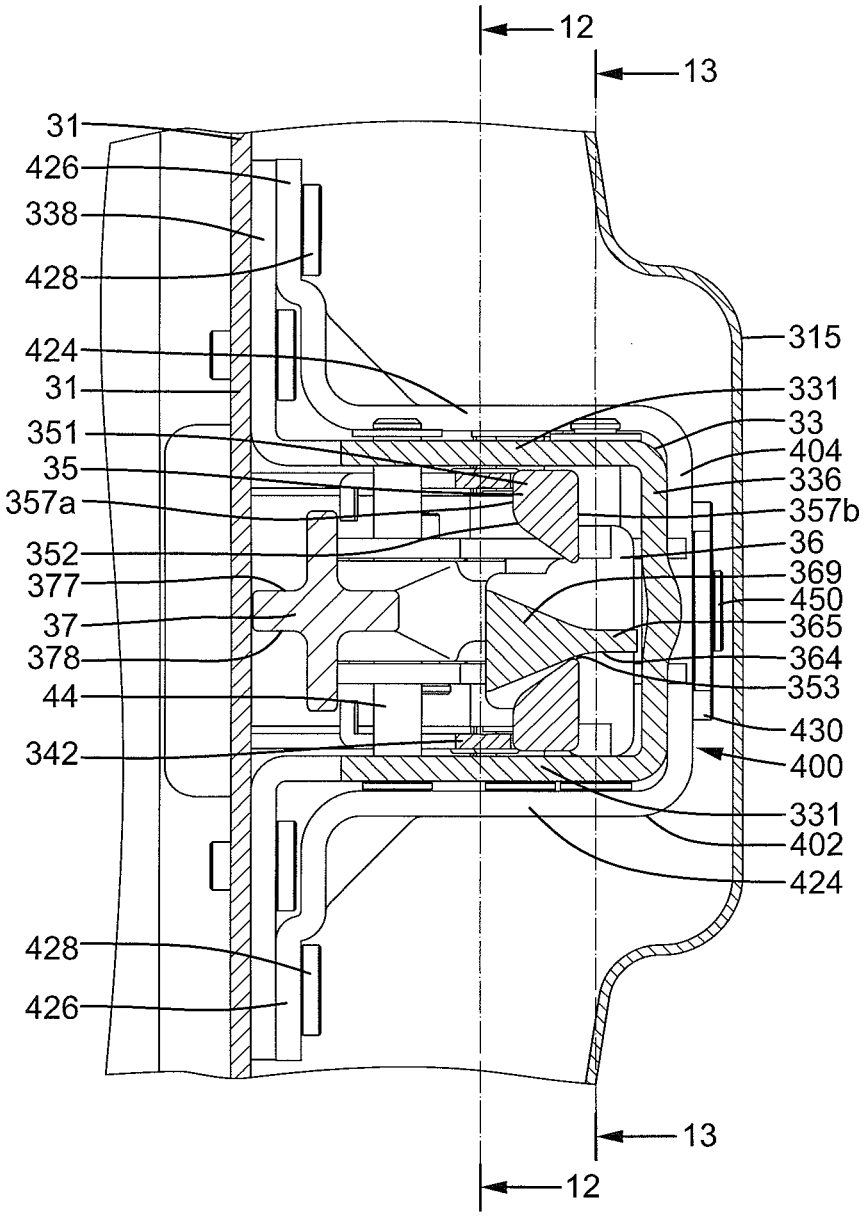
FIG. 11 shows a cross-sectional view taken along section line 11-11 of FIG. 10.
Figure 12:
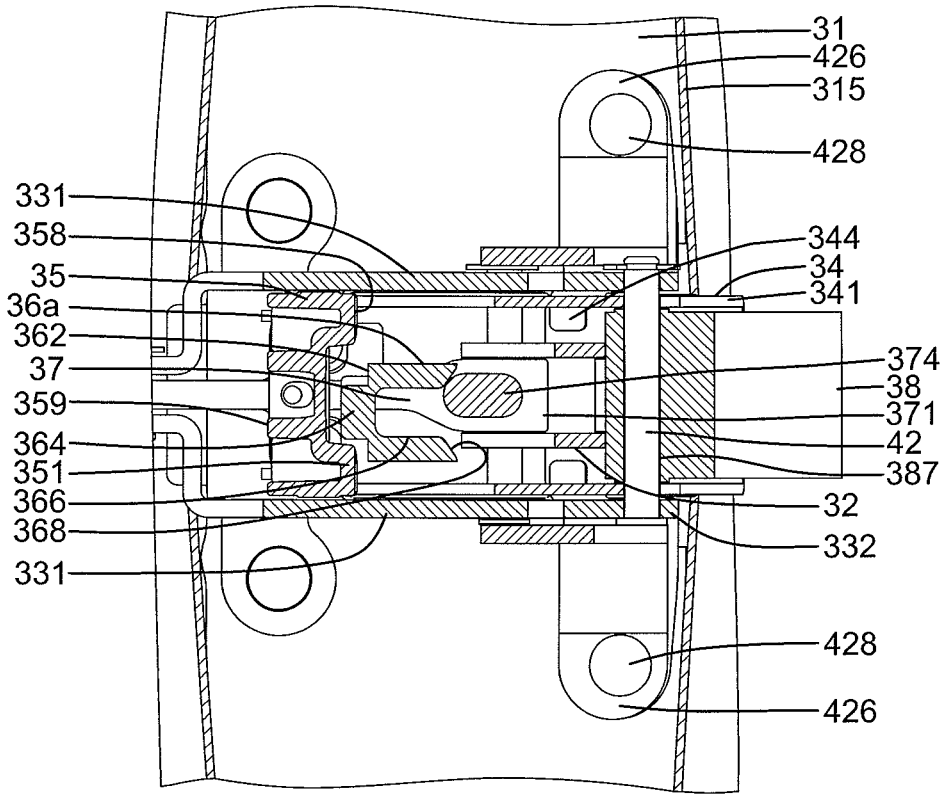
FIG. 12 shows a cross-sectional view taken along section line 12-12 of FIG. 11.
Figure 13:
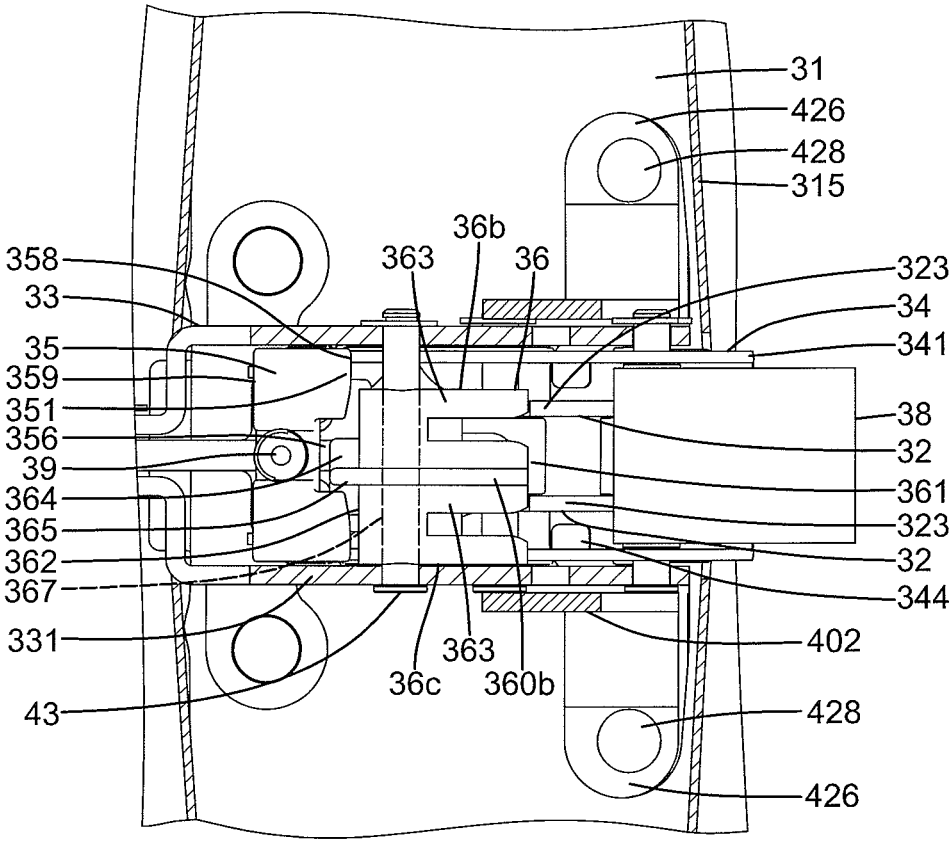
FIG. 13 shows a cross-sectional view taken along section line 13-13 of FIG. 11.

When door 1 is completely closed, first ends 341 of first and second side boards 345 of swaying plate 1 are pressed against and retained in place by stop 12 in the inner, second position (FIG. 11). Limiting block 35 is retained in the releasing position. Note that locking member 36 is no longer restrained by limiting block 35, since the second, smaller end 353 of guide groove 356 is aligned with and receives narrower section 365 of guide piece 364 of locking member 36 (FIG. 12). At the same time, latch 38 returns to its extended, latching position under the action of spring 226, and second face 385 of latch 38 presses against stop 12 to lock door 1. Furthermore, linking rod 37 moves in the latching direction toward latch 38, such that protrusion 374 of linking rod 37 disengages from groove 366 of locking member 36. Thus, locking member 36 is released from protrusion 374 and moves downward along guide pin 43 (along first axis X) under the action of gravitational force to the lower, locking position resting on an inner face of second sidewall 331 (FIGS. 11-13). As a result, guide grooves 363 no longer align with extensions 323 of follower 32 as extensions 323 now abut front face 361 of locking member 36. Namely, when door 1 is completely closed, pivotal movement of latch 38 from the extended, latching position to the retracted, unlatching position is prevented, since the follower 32 that pivots together with latch 38 can not pivot inward due to the fact that extensions 323 of follower 32 are not aligned with and, thus, can not pivot into guide grooves 363 of locking member 36. An anti-picking function is, thus, provided. In this case, protrusion 374 of linking rod 37 is not aligned with and outside of groove 366 of locking member 36. Furthermore, protrusion 374 of linking rod 37 abuts against a wall portion of end opening 368 (FIG. 12).

Figure 15:
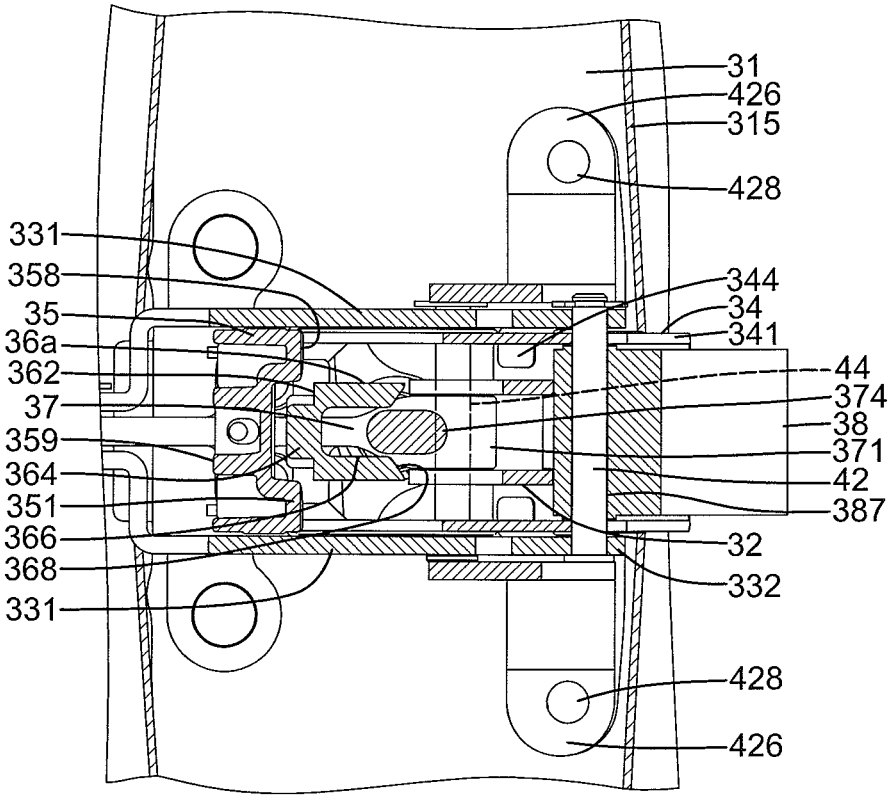
FIG. 15 shows a view similar to FIG. 9, with the operative member pressed and with a locking member returned to an alignment position.

When opening of door 1 is desired, operative member 21 is pressed to an extent to move linking rod 37 in the unlocking direction through pivotal movement of rocker 22. Specifically, linking rod 37 moves through its idle travel equal to the length of slot 373 without moving limiting pin 44 and follower 32 (FIG. 16). During the idle travel of linking rod 37, protrusion 374 of linking rod 37 moves through end opening 368 into groove 366 of locking member 36 (FIG. 15) and moves locking member 36 upward along guide pin 43 to the upper, unlocking position so that guide grooves 363 of locking member 36 are aligned with extensions 323 of follower 32 (see FIG. 7). Note that limiting pin 44 is now in front end 373*a* of slot 37. When operative member 21 is further pressed, linking rod 37 moves further in the unlatching direction to move limiting pin 44 in the unlatching direction. As a result, latch 38 pivots together with follower 32 to the retracted, unlatching position allowing opening of door 1. At the same time, extensions 323 of follower 32 moves from the location adjacent to front ends 414A of first and second slots 414 of connecting seat 402 to the location adjacent to the location adjacent rear ends 414B of first and second slots 414 of connecting seat 402.

With reference to FIG. 10, when door 1 is in the closed state and a fire occurs, positioning member 452 made of plastic material melts earlier than other components made of metal under the heat of the fire. Anchor 430 pivots about third axis Z from the alignment position (FIG. 6) to the anchoring position (FIG. 19) under the action of gravity. Stop portion 440 of anchor 430 is received in and blocks first and second slots 414 of connecting seat 402, such that extensions 323 of follower 32 can not move from front ends 414A of first and second slots 414 to rear ends 414B of first and second slots 414, preventing latch 38 from moving to the unlatching position such as by high-pressure water or steam transformed from the water for extinguishing the fire. The risk of opening of the door during the fire is, thus, avoided, effectively avoiding the spread of the fire and smoke.

Use of stop device 400 with locking member 36 provides synergistic results. Specifically, when a fire occurs adjacent to door lock 2, latch 38 can be moved to the unlatching position (by pressing operative member 21 or by pressing third face 386 of latch 38) only when locking member 36 is in the alignment position while anchor 430 is in the alignment position. This significantly reduces the possibility of inadvertent opening of door 1 during the fire.

Now that the basic teachings of the present invention have been explained, many extensions and variations will be obvious to one having ordinary skill in the art. For example, positioning groove 420 can be formed in connecting seat 402 at a location other than end face 418 of tongue 416, and anchor 430 does not have to include engagement groove 448. As an example, positioning groove 420 can be formed in any location of first surface 406 of mounting plate 404 spaced from axle hole 422, and through-hole 446 of anchor 430 is located in a location aligned with positioning groove 420 when anchor 430 is in the alignment position, such that positioning member 452 can extend through through-hole 446 into positioning groove 420. When positioning member 452 melts due to a fire, anchor 430 can pivot about third axis Z from the alignment position to the anchoring position. Furthermore, groove 410 of connecting seat can be of other shapes as long as it provides sufficient space allowing pivotal movement of anchor 430 between the anchoring position and the alignment position.

Furthermore, follower 32 can include only one extension 323, bracket 33 can include only one guide slot 337, and connecting seat 402 can include only one slot 414 aligned with guide slot 337. Also, anchor 430 can include only one notch 441 aligned with slot 414. When anchor 430 is in the anchoring position, anchor 430 can still prevent movement of follower 32, such that latch 38 can not move to the unlatching position. Latch device 30 does not have to include swaying plate 34, limiting block 35, locking member 36, guide rod 39, and spring 393 without adverse affect to the functions of anchor 430.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door lock comprising:

a bracket adapted to be fixed to a side of a door;

a latch mounted to the bracket and pivotable about a first axis between an extended, latching position and a retracted, unlatching position;

a follower including a first end pivotably connected to the latch, a second end spaced from the first end of the follower along a second axis perpendicular to the first axis, and an extension located intermediate the first and second ends of the follower and extending along a third axis perpendicular to the first and second axes;

a linking rod including first and second ends spaced along the second axis, with the first end of the linking rod pivotably connected to the second end of the follower, with the second end of the linking rod movable in an unlatching direction for moving the latch from the extended, latching position to the retracted, unlatching position and movable in a latching direction opposite to the unlatching direction for moving the latch from the retracted, unlatching position to the extended, latching position, with an operative member adapted to be operatively connected to the linking rod and operable to move the linking rod in the unlatching direction and the latching direction;

a connecting seat fixed to the bracket and including a mounting plate, with the mounting plate including first and second surfaces spaced along the third axis, with a first slot extending from the first surface through the second surface, with a groove extending from the first surface through the second surface and intersecting the first slot, with a positioning groove formed in the first surface of the connecting seat, with the extension extending into and movable along the first slot;

an anchor pivotably mounted to the connecting seat, with the anchor including a pivotal section and an anchoring section spaced from the pivotal section along the second axis, with the anchor further including first and second sides spaced along the third axis, with the anchoring section including a stop portion extending from the second side of the anchor along the third axis, with the stop portion further including inner and outer peripheral faces spaced along the second axis, with a first notch extending from the inner peripheral face through the outer peripheral face, with a through-hole extending from the first side through the second side of the anchor, with the pivotal section of the anchor pivotably mounted to the connecting seat, with the stop portion received in the groove of the connecting seat, with the anchor pivotable in the groove about the third axis between an alignment position and an anchoring position, with the through-hole of the anchor aligned with the positioning groove of the connecting seat and with the first notch of the anchor aligned with the first slot of the connecting seat when the anchor is in the alignment position, with the through-hole of the anchor misaligned from the positioning groove of the connecting seat, the first notch of the anchor misaligned from the first slot of the connecting seat, and the stop portion of the anchor received in and blocking the first slot when the anchor is in the anchoring position; and a positioning member fixed in the through-hole of the anchor, with a portion of the positioning member received in the positioning groove to retain the anchor in the alignment position, wherein when the positioning member melts due to heat of a fire, the anchor pivots about the third axis from the alignment position to the anchoring position under action of gravity, preventing movement of the follower and preventing the latch from moving from the extended, latching position to the retracted, unlatching position.

2. The door lock as claimed in claim 1, with the connecting seat further including a second slot extending from the first surface through the second surface and spaced from the first slot along the first axis, with each of the first and second slots including front and rear ends spaced along the second axis, with the groove including first and second ends spaced in a circumferential direction about the third axis, with the rear ends of the first and second slots located intermediate and spaced from the first and second ends of the groove along the first axis, with the first and second slots and the groove of the connecting seat together defining a tongue including an end face facing the front ends of the first and second slots, with the positioning groove formed in the end face of the tongue, with the anchor further including a second notch extending from the inner peripheral face through the outer peripheral face and spaced from the first notch along the first axis, with the stop portion including two distal ends spaced in a circumferential direction about the third axis, wherein when the anchor is in the alignment position, the second notch of the anchor is aligned with the second slot of the connecting seat, wherein when the anchor is in the anchoring position, the second notch of the anchor is misaligned from the second slot of the connecting seat, and the second distal end of the stop portion of the anchor abuts the second end of the groove of the connecting seat.

3. The door lock as claimed in claim 2, with the through-hole of the anchor extending to the inner peripheral wall of the stop portion along the third axis, with an engagement groove formed in the inner peripheral wall of the stop portion, with the engagement groove of the anchor aligned with the positioning groove of the connecting seat when the anchor is in the alignment position.

4. The door lock as claimed in claim 1, with the connecting seat including first and second legs extending from two ends of the mounting plate along the third axis, with each of the first and second legs fixed to the bracket, with the bracket received between the first and second legs.

5. The door lock as claimed in claim 1, with the bracket being U-shaped and including first and second sidewalls spaced along the first axis and an interconnecting wall interconnected between the first and second sidewalls, with the interconnecting wall including a guide slot aligned with the first slot of the connecting seat, with the extension of the follower extending through the guide slot of the bracket and the slot of the connecting seat.

6. The door lock as claimed in claim 5, with the first and second sidewalls of the bracket further including aligned slots, with the latch pivotably mounted to the bracket by a latch pin, with the first end of the linking rod including a slot aligned with the slots of the bracket, with the first end of the follower pivotably connected by a pivot to the latch;

a limiting pin slideably extending through the slots of the bracket and the slot of the linking rod, with the limiting pin extending through the second end of the follower, allowing joint pivotal movement of the limiting pin and the second end of the follower about a pivot axis defined by the pivot, with the linking rod movable through an idle travel along the second axis without moving the limiting pin, the follower, and the latch;

a swaying plate including first and second ends and a pivotal portion intermediate the first and second ends of the swaying plate, with the latch pin extending through the pivotal portion, the latch, and the bracket, allowing the first end of the swaying plate to pivot between first and second positions about a pivot axis defined by the latch pin;

a limiting block fixed to the second end of the swaying plate to move therewith, with the limiting block movable between a holding position corresponding to the first position of the first end of the swaying plate and a releasing position corresponding to the second position of the first end of the swaying plate;

a locking member coupled to and actuatable by the limiting block, with the locking member including a guide groove removably receiving the extension of the follower, with the locking member releasably coupled with the linking rod and movable between an unlocking position and a locking position, with the locking member held in the unlocking position by the limiting block in the holding position, with the locking member movable between the unlocking position and the locking position when the limiting block is in the releasing position, with the guide groove of the locking member aligned with the extension of the follower when the locking member is in the unlocking position, allowing pivotal movement of the latch and the follower about the pivot axis defined by the latch pin to the retracted, unlatching position and allowing the extension of the follower to pivot into the guide groove of the locking member, with the guide groove of the locking member misaligned from the extension of the follower and not allowing pivotal movement of the latch and the follower about the pivot axis defined by the latch pin to the retracted position of the latch when the locking member is in the locking position;

wherein when the door is in an open position, the first end of the swaying plate is in the first position, the latch is in the extended, latching position, the limiting block is in the holding position holding the locking member in the unlocking position, and movement of the linking rod in the unlatching position causes pivotal movement of the latch from the extended, latching position to the retracted, unlatching position, wherein when the door is in a closed position, the first end of the swaying plate is retained in the second position, the latch is in the extended, latching position, the limiting block is in the releasing position releasing the locking member to the locking position not allowing direct pivotal movement of the latch from the extended, latching position to the retracted, unlatching position, movement of the linking rod in the unlatching position through the idle travel causes movement of the locking member from the locking position to the unlocking position, and further movement of the linking rod in the unlatching position causes pivotal movement of the latch from the extended, latching position to the retracted, unlatching position and causes movement of the extension of the follower into the guide groove of the locking member, wherein when the anchor is in the anchoring position and when the locking member is in the locking position, the guide groove of the locking member is misaligned from the first notch of the anchor, with the extension of the follower stopped by the stop portion of the anchor, preventing the latch from moving from the extended, latching position to the retracted, unlatching position.

* * * * *